US005657627A

United States Patent [19]

Akazaki et al.

[11] Patent Number: 5,657,627

[45] Date of Patent: Aug. 19, 1997

[54] AIR-FUEL RATIO CONTROL SYSTEM FOR INTERNAL COMBUSTION ENGINES

[75] Inventors: Shusuke Akazaki; Kotaro Miyashita; Ken Ogawa; Yoshihisa Hara, all of Wako, Japan

[73] Assignee: Honda Giken Kogyo Kabushiki Kaisha, Tokyo, Japan

[21] Appl. No.: 517,857

[22] Filed: Aug. 22, 1995

[30] Foreign Application Priority Data

Sep. 16, 1994 [JP] Japan ..... 6-248887

[51] Int. Cl.[6] ..... F02D 41/14

[52] U.S. Cl. ..... 60/276; 60/285

[58] Field of Search ..... 60/285, 276, 274, 60/299

[56] References Cited

U.S. PATENT DOCUMENTS

| | | | |
|---|---|---|---|
| 5,357,754 | 10/1994 | Ogawa et al. | 60/285 X |
| 5,533,332 | 7/1996 | Uchikawa | 60/285 X |
| 5,537,817 | 7/1996 | Akazaki et al. | 60/276 |

FOREIGN PATENT DOCUMENTS

| | | | |
|---|---|---|---|
| 0099611 | 5/1987 | Japan | 60/276 |
| 5-321721 | 12/1993 | Japan . | |
| 6-74081 | 3/1994 | Japan . | |

*Primary Examiner*—Hoang Nguyen

*Attorney, Agent, or Firm*—Nikaido, Marmelstein, Murray & Oram LLP

[57] ABSTRACT

An air-fuel ratio control system for an internal combustion engine having at least one catalytic converter arranged in the exhaust passage, comprises an ECU which changes air intake characteristics of the engine, based on operating conditions of the engine, and a plurality of exhaust gas component concentration sensors including at least upstream and downstream exhaust gas component concentration sensors arranged in the exhaust passage at respective locations upstream and downstream of the at least one catalytic converter. The air-fuel ratio of an air-fuel mixture to be supplied to the engine is controlled to a desired air-fuel ratio in a feedback manner responsive to an output from the upstream exhaust gas component concentration sensor. A feedback control parameter for use in the air-fuel ratio feedback control is calculated based on an output from the downstream exhaust gas component concentration sensor. The updating rate of the feedback control parameter is changed when the feedback control parameter is calculated, according to the air intake characteristics of the engine.

15 Claims, 14 Drawing Sheets

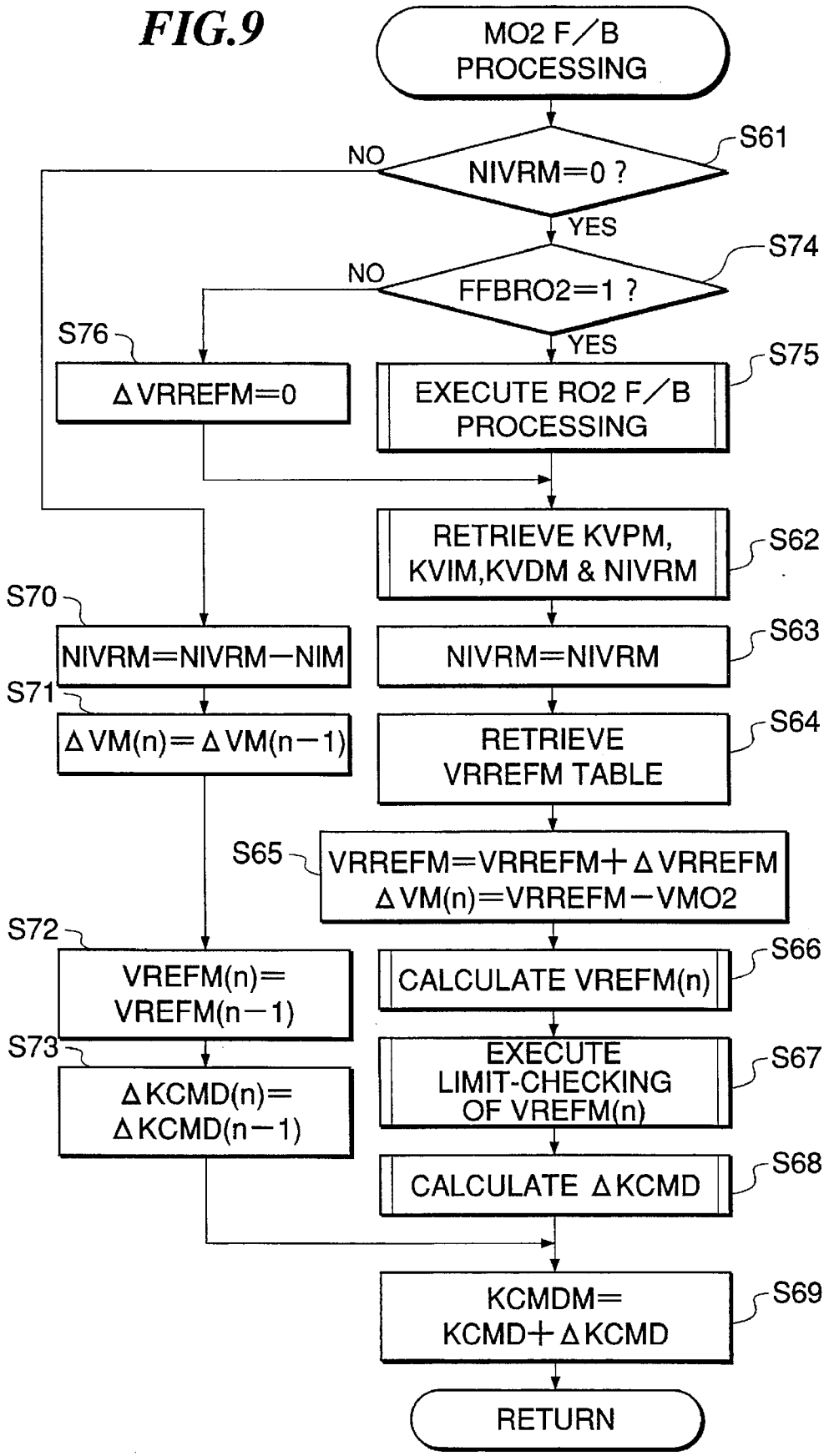
FIG.9
MO2 F/B PROCESSING
S61
NIVRM=0 ?
NO
YES
S74
FFBRO2=1 ?
NO
YES
S76
ΔVRREFM=0
S75
EXECUTE RO2 F/B PROCESSING
RETRIEVE KVPM, KVIM,KVDM & NIVRM
S62
S70
NIVRM=NIVRM−NIM
S63
NIVRM=NIVRM
S71
ΔVM(n)=ΔVM(n−1)
S64
RETRIEVE VRREFM TABLE
S65
VRREFM=VRREFM+ΔVRREFM
ΔVM(n)=VRREFM−VMO2
S72
VREFM(n)= VREFM(n−1)
S66
CALCULATE VREFM(n)
S73
ΔKCMD(n)= ΔKCMD(n−1)
S67
EXECUTE LIMIT-CHECKING OF VREFM(n)
S68
CALCULATE ΔKCMD
S69
KCMDM= KCMD+ΔKCMD
RETURN

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system for an internal combustion engine which is provided with a device capable of changing air intake characteristics of the engine in dependence on operating conditions of the engine.

2. Prior Art

There is conventionally known a method of controlling the air-fuel ratio of an air-fuel mixture to be supplied to an internal combustion engine in a feedback manner responsive to outputs from first and second exhaust gas component concentration sensors for sensing concentration of an exhaust gas component, arranged in the exhaust passage of the engine at respective locations upstream and downstream of an exhaust gas-purifying catalytic converter arranged in the exhaust passage, for example, from Japanese Laid-Open Patent Publication (Kokai) No. 5-321721.

Further, an air-fuel ratio control system for internal combustion engines, for example, from Japanese Laid-Open Patent Publication (Kokai) No. 6-74081, is also conventionally known, which is provided with first and second catalytic converters serially arranged in the exhaust passage in this order from the upstream side of the exhaust passage, a bypass passage bypassing the first catalytic converter, a changeover valve for changing the flow passage of exhaust gases between one passing through the first catalytic converter and one passing through the bypass passage, and a valve operation-changeover mechanism for changing the operative states of intake valves and exhaust valves of the engine, wherein the fuel supply amount and the basic control amount of ignition timing are changed in dependence on the operative state of the changeover valve as well as the operative states of the intake valves and exhaust valves.

However, according to the control system known from Japanese Laid-Open Patent Publication (Kokai) No. 6-74081, changeover of the operative states of the intake valves and exhaust valves causes a change in air intake characteristics of the engine, resulting in a change in transfer delay of exhaust gases. As a result, if the air-fuel ratio feedback control method known from Japanese Laid-Open Patent Publication (Kokai) No. 5-321721 is directly applied to the above control system, the controllability of the air-fuel ratio can be degraded, resulting in temporary degradation of exhaust emission characteristics of the engine.

SUMMARY OF THE INVENTION

It is the object of the invention to provide an air-fuel ratio control system for an internal combustion engine provided with a device for changing air intake characteristics of the engine, which is capable of improving the controllability and convergency of feedback control of the air-fuel ratio of an air-fuel mixture supplied to the engine, to thereby always achieve excellent exhaust emission characteristics of the engine.

To attain the above object, the present invention provides an air-fuel ratio control system for an internal combustion engine having an exhaust passage, and at least one catalytic converter arranged in said exhaust passage, for purifying exhaust gases emitted from said engine, comprising:

air intake characteristic-changing means for changing air intake characteristics of said engine, based on operating conditions of said engine;

a plurality of exhaust gas component concentration sensors including at least an upstream exhaust gas component concentration sensor and a downstream exhaust gas component concentration sensor arranged in said exhaust passage at respective locations upstream and downstream of said at least one catalytic converter, for detecting concentration of a specific component in said exhaust gases;

first feedback control means for controlling an air-fuel ratio of an air-fuel mixture to be supplied to said engine to a desired air-fuel ratio in a feedback manner responsive to an output from said upstream exhaust gas component concentration sensor;

second feedback control means for calculating a feedback control parameter for use by said first feedback control means, based on an output from said downstream exhaust gas component concentration sensor; and updating rate-changing means for changing an updating rate of said feedback control parameter when said feedback control parameter is calculated, according to an operative state of said air intake characteristic-changing means.

Preferably, the engine includes at least one intake valve, and at least one exhaust valve, said air intake characteristic-changing means changing valve timing of at least one of said at least one intake valve and said at least one exhaust valve, based on operating conditions of said engine.

Also preferably, the engine includes an intake passage, said air intake characteristic-changing means changing at least one of a cross sectional area of said intake passage and a length of said intake passage, based on operating conditions of said engine.

Also preferably, the engine includes at least one intake valve, at least one exhaust valve, and an intake passage, said air intake characteristic-changing means changing valve timing of at least one of said at least one intake valve and said at least one exhaust valve, and also changing at least one of a cross sectional area of said intake passage and a length of said intake passage, based on operating conditions of said engine.

Advantageously, the engine includes a first catalytic converter arranged in said exhaust passage, and a second catalytic converter arranged in said exhaust passage at a location downstream of said first catalytic converter, said air-fuel ratio control system including a first exhaust gas component concentration sensor arranged at a location upstream of said first catalytic converter, a second exhaust gas component concentration sensor arranged at a location downstream of said first catalytic converter and upstream of said second catalytic converter, and a third exhaust gas component concentration sensor arranged at a location downstream of said second catalytic converter, said first exhaust gas component concentration sensor forming said upstream exhaust gas component concentration sensor, said second exhaust gas component concentration sensor forming said downstream exhaust gas component concentration sensor.

Alternatively, the engine includes a first catalytic converter arranged in said exhaust passage, and a second catalytic converter arranged in said exhaust passage at a location downstream of said first catalytic converter, said air-fuel ratio control system including a first exhaust gas component concentration sensor arranged at a location upstream of said first catalytic converter, a second exhaust gas component concentration sensor arranged at a location downstream of said first catalytic converter and upstream of said second catalytic converter, and a third exhaust gas component concentration sensor arranged at a location downstream of said second catalytic converter, said second exhaust gas component concentration sensor forming said upstream exhaust gas component concentration sensor, said third exhaust gas component concentration sensor forming said downstream exhaust gas component concentration sensor.

Specifically, the feedback control parameter corresponds to said desired air-fuel ratio (KCMDM).

Preferably, the updating rate-changing means changes control gains (KVPM, KVIM, and KVDM) for use in calculating said feedback control parameter, according to said operative state of said air intake characteristic-changing means.

Also preferably, the feedback control parameter is a reference output (VRREFM) to be compared with an output from said second exhaust gas component concentration sensor to determine said desired air-fuel ratio (KCMDM).

More preferably, the updating rate-changing means changes control gains (KVPR, KVIR, and KVDR) for use in calculating a correction value (ΔVRREFM) for correcting said reference output (VRREFM), based on an output from said third exhaust gas component concentration sensor, according to said operative state of said air intake characteristic-changing means.

Further preferably, the updating rate characteristic-changing means changes correction values (ΔKVPM, ΔKVIM, and ΔKVDM) for correcting control gains (KVPM, KVIM, and KVDM) for use in calculating said feedback control parameter, based on an output from said third exhaust gas component concentration sensor, according to said operative state of said air intake characteristic-changing means.

In a preferred embodiment of the invention, there is provided an air-fuel ratio control system for an internal combustion engine having an exhaust passage, and at least one catalytic converter arranged in said exhaust passage, for purifying exhaust gases emitted from said engine, comprising:

air intake characteristic-changing means for changing air intake characteristics of said engine, based on operating conditions of said engine;

a plurality of exhaust gas component concentration sensors including at least an upstream exhaust gas component concentration sensor and a downstream exhaust gas component concentration sensor arranged in said exhaust passage at respective locations upstream and downstream of said at least one catalytic converter, for detecting concentration of a specific component in said exhaust gases;

first feedback control means for controlling an air-fuel ratio of an air-fuel mixture to be supplied to said engine to a desired air-fuel ratio in a feedback manner using a first feedback control parameter (KCMDM) and a second feedback control parameter (KLAF) based on an output from said upstream exhaust gas component concentration sensor;

second feedback control means for calculating said first feedback control parameter for use by said first feedback control means, based on an output from said downstream exhaust gas component concentration sensor;

first updating rate-changing means for changing an updating rate of said first feedback control parameter effected when said first feedback control parameter is calculated, according to an operative state of said air intake characteristic-changing means; and second updating rate-changing means for changing an updating rate of said second feedback control parameter effected when said second feedback control parameter is calculated, according to an operative state of said air intake characteristic-changing means.

Preferably, the second updating rate-changing means changes control gains (KP, KI, and KD) for use in calculating said second feedback control parameter, according to said operative state of said air intake characteristic-changing means.

The above and other objects, features, and advantages of the invention will become more apparent from the ensuing detailed description taken in conjunction with the accompanying drawings.

BRIEF DESCRIPTION OF THE DRAWINGS

FIG. 9 is a flowchart showing a subroutine for carrying out feedback control based on an MO2 sensor, which is executed by the FIG. 6 routine;

DETAILED DESCRIPTION

The invention will now be described in detail with reference to the drawings showing an embodiment thereof.

Figure 1:
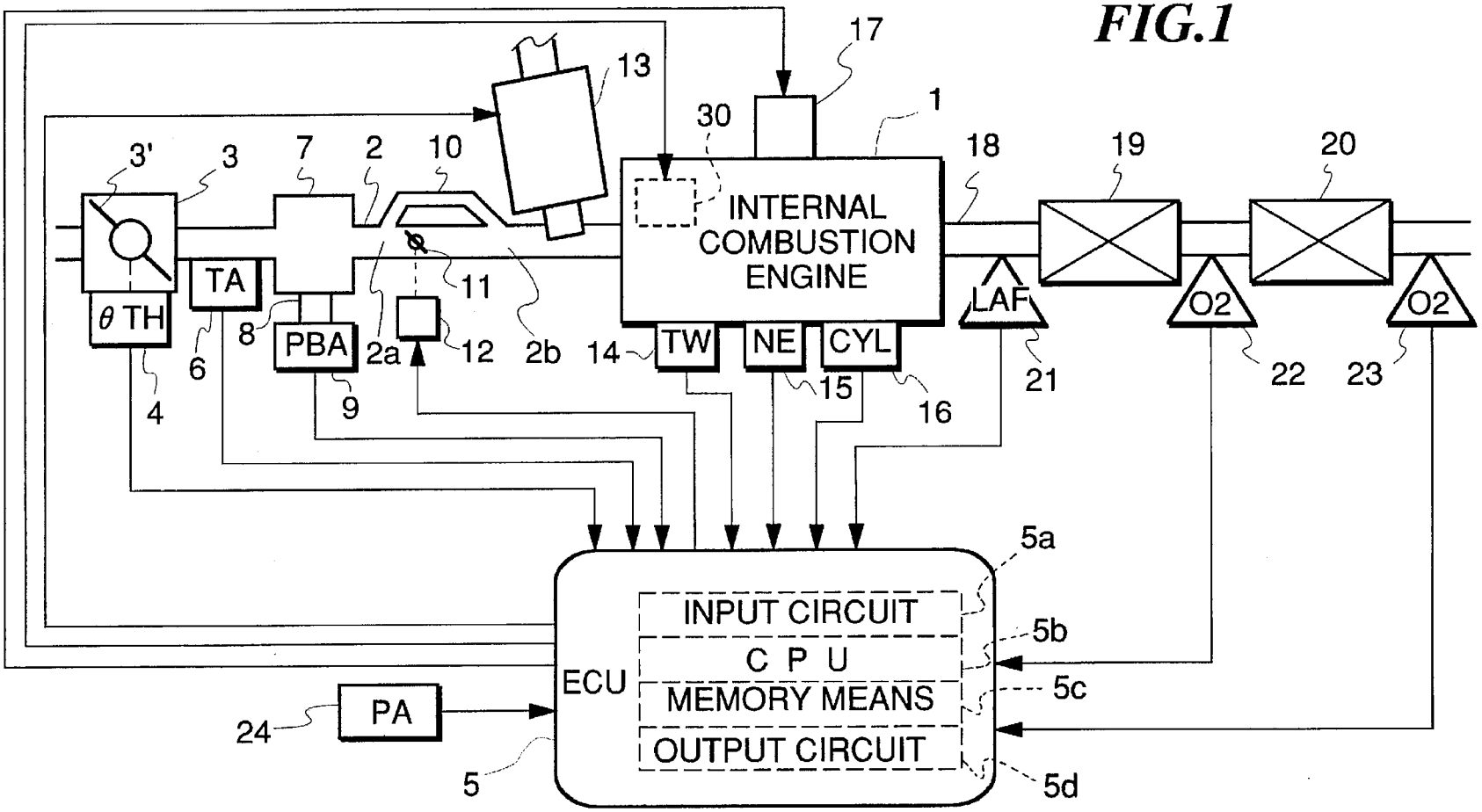
FIG. 1 is a block diagram schematically showing the arrangement of an internal combustion engine and an air-fuel ratio control system therefor, according to an embodiment of the invention.

Referring first to FIG. 1, there is schematically illustrated the whole arrangement of an internal combustion engine and an air-fuel ratio control system therefor, according to an embodiment of the invention.

In the figure, reference numeral 1 designates a DOHC straight type four-cylinder internal combustion engine (hereinafter simply referred to as "the engine"), each cylinder being provided with a pair of intake valves, not shown, and a pair of exhaust valves, not shown. The engine 1 has a valve timing changeover mechanism 30 which can change valve timing (valve operative states, such as the valve lift and the valve opening period) of the intake valves and exhaust valves between high-speed valve timing suitable for operation of the engine in a high rotational speed region and low-speed valve timing suitable for operation of the engine in a low rotational speed region.

Specifically, the valve timing changeover mechanism 30 has a solenoid valve, not shown, for controlling changeover of the valve timing, which is electrically connected to an electronic control unit (hereinafter referred to as "the ECU") 5 to have its valving operation controlled by a signal from the ECU 5. The solenoid valve changes operating oil pressure for the valve timing changeover mechanism 30 from a high level to a low level or vice versa, so that the valve timing is changed over from the high-speed valve timing to the low-speed valve timing or vice versa. The oil pressure in the mechanism 30 is detected by an oil pressure sensor, not shown, and the detected oil pressure signal is supplied to the ECU 5.

Connected to the cylinder block of the engine 1 is an intake pipe 2 across which is arranged a throttle body 3 accommodating a throttle valve 3' therein. A throttle valve opening (θTH) sensor 4 is connected to the throttle valve 3' for generating an electric signal indicative of the sensed throttle valve opening and supplying the same to the ECU 5.

An intake air temperature (TA) sensor 6 is mounted in the wall of the intake pipe 2 at a location downstream of the throttle valve 3', for supplying an electric signal indicative of the sensed intake air temperature TA to the ECU 5.

A chamber 7 is arranged across the intake pipe 2 at a location downstream of the TA sensor 6, and an intake pipe absolute pressure (PBA) sensor 9 is provided in communication with the interior of the chamber 7 via a conduit 8 opening into the same, for supplying an electric signal indicative of the sensed absolute pressure PBA within the intake pipe 2 to the ECU 5.

Bypass valves 11, only one of which is shown, are arranged in a manifold of the intake pipe 2, at locations downstream of the chamber 7, and low-speed passages 10, only one of which is shown, are each connected to the manifold in a fashion bypassing the corresponding bypass valve 11. The diameter of the low-speed passage 10 is smaller than that of the manifold of the intake pipe 2, while the length of the passage 10 is longer than that of a section of the manifold of the intake pipe 2 corresponding to the passage 10, i.e. the section between points **2*a* and 2*b* shown in FIG. 1. The bypass valve 11 is mechanically connected to an actuator 12 which is electrically connected to the ECU 5. The ECU 5 supplies a control signal to the actuator 12 for controlling opening and closing of the bypass valve 11. The bypass valve 11 is closed to allow intake air to be supplied to the engine 1 only through the passage 10 when the engine is operating in a low rotational speed region, while it is opened to allow intake air to be supplied to the engine also through the section 2*a*–2*b* of the intake pipe 2 when the engine 1 is operating in a high rotational speed region. Thus, intake air flows through the intake passage which is larger in diameter and shorter in length than the passage 10** suitable for the low-speed operation of the engine, during the high-speed operation of the engine.

By thus opening and closing the bypass valve 11, the intake passage is changed over between the passage 10 suitable for low rotational speed operation and the section **2*a*–2*b* of the intake pipe 2** suitable for high rotational speed operation.

Fuel injection valves 13, only one of which is shown, are inserted into the interior of the intake pipe 2 at locations intermediate between the joint point **2*b* of the low-speed passage 10 with the intake pipe 2, and the cylinder block of the engine 1 and slightly upstream of respective intake valves, not shown. The fuel injection valves 13 are connected to a fuel pump, not shown, and electrically connected to the ECU 5** to have their valve opening periods controlled by signals therefrom.

An engine coolant temperature (TW) sensor 14 formed of a thermistor or the like is inserted into a coolant passage filled with a coolant and formed in the cylinder block, for supplying an electric signal indicative of the sensed engine coolant temperature TW to the ECU 5.

An engine rotational speed (NE) sensor 15 and a cylinder-discriminating (CYL) sensor 16 are arranged in facing relation to a camshaft or a crankshaft of the engine 1, neither of which is shown.

The NE sensor 15 generates a pulse as a TDC signal pulse at each of predetermined crank angles whenever the crankshaft rotates through 180 degrees, while the CYL sensor 16 generates a pulse at a predetermined crank angle of a particular cylinder of the engine, both of the pulses being supplied to the ECU 5.

Each cylinder of the engine 1 has a spark plug 17 electrically connected to the ECU 5 to have its ignition timing controlled by a signal therefrom.

First and second catalytic converters 19 and 20 are serially arranged in an exhaust pipe 18 connected to the cylinder block of the engine 1, in this order from the upstream side of the exhaust pipe 18, for purifying noxious components in exhaust gases from the engine, such as HC, CO, and NOx.

A linear-output oxygen concentration sensor (hereinafter referred to as "the LAF sensor") 21 as a first exhaust gas component concentration sensor is arranged in the exhaust pipe 18 at a location upstream of the first catalytic converter 19. Further, a first oxygen concentration sensor (hereinafter referred to as "the MO2 sensor") 22 as a second exhaust gas component concentration sensor is arranged in the exhaust pipe 18 at a location intermediate between the first and second catalytic converters 19 and 20, and a second oxygen concentration sensor (hereinafter referred to as "the RO2 sensor") 23 as a third exhaust gas component concentration sensor, at a location downstream of the second catalytic converter 20, respectively.

The LAF sensor 21 is comprised of a sensor element formed of a solid electrolytic material of zirconia (ZrO) and having two pairs of cell elements and oxygen pumping elements mounted at respective upper and lower locations thereof, and an amplifier circuit electrically connected to the sensor element. The LAF sensor 21 generates an output signal having a level substantially proportional to the oxygen concentration in exhaust gases flowing through the sensor element and supplies the same to the ECU 5.

The MO2 sensor 22 and the RO2 sensor 23 are also comprised of a sensor element formed of a solid electrolytic material of zirconia (ZrO) like the LAF sensor 21 and having an output characteristic that an electromotive force thereof drastically changes as the air-fuel ratio of exhaust gases changes across a stoichiometric value so that an output therefrom is inverted from a lean value-indicating signal to a rich value-indicating signal or vice versa as the air-fuel ratio of the exhaust gases changes across the stoichiometric value. More specifically, the O2 sensors 22 and 23 generate high level signals when the air-fuel ratio of exhaust gases is richer than the stoichiometric value, and low level signals when the former is leaner than the latter. The output signals from the O2 sensors 22 and 23 are supplied to the ECU An atmospheric pressure (PA) sensor 24 is arranged at a suitable portion of the engine 1 for supplying the ECU 5 with an electric signal indicative of the atmospheric pressure PA sensed thereby.

The ECU 5 is comprised of an input circuit 5*a* having the functions of shaping the waveforms of input signals from various sensors including those mentioned above, shifting the voltage levels of sensor output signals to a predetermined level, converting analog signals from analog-output sensors to digital signals, and so forth, a central processing unit (hereinafter referred to as the "the CPU") 5*b*, memory means 5*c* formed of a ROM storing various operational programs which are executed by the CPU 5*b*, and various maps and tables, referred to hereinafter, and a RAM for storing results of calculations therefrom, etc., an output circuit 5*d* which outputs driving signals to the actuator 12, the fuel injection valves 13, the spark plugs 17, and the solenoid valve of the valve timing changeover mechanism 30.

The CPU 5*b* operates in response to signals from various sensors mentioned above to determine operating conditions in which the engine 1 is operating, such as an air-fuel ratio feedback control region in which air-fuel ratio control is carried out in response to oxygen concentration in exhaust gases, and open-loop control regions, and calculates, based upon the determined engine operating conditions, a fuel injection period TOUT for each of the fuel injection valves 13, in synchronism with generation of TDC signal pulses, by the use of the following equation (1) when the engine is in a basic operating mode, and by the use of the following equation (2) when the engine is in a starting mode, and stores results of calculation into the memory means 5*c* (RAM):

$$TOUT=TiM\times KCMDM\times KLAF\times K1+K2 \quad (1)$$

$$TOUT=TiCR\times K3+K4 \quad (2)$$

where TiM represents a basic fuel injection period for use in the basic operating mode, which is determined according to the engine rotational speed NE and the intake pipe absolute pressure PBA. A TiM map for determining the TiM value is stored in the memory means 5*c* (ROM).

The TiM map is comprised of four maps corresponding to the open/closed states of the bypass valve 11 and the valve timing, i.e. a first operating state in which the bypass valve 11 is closed (to supply intake air through the low-speed passage alone for low-speed operation) and the low-speed valve timing is selected, a second operating state in which the bypass valve 11 is open (to supply intake air through both the low-speed passage and the intake passage section 2*a*–2*b* for high-speed operation) and the low-speed valve timing is selected, a third operating state in which the bypass valve 11 is closed and the high-speed valve timing is selected, and a fourth operating state in which the bypass valve 11 is open and the high-speed valve timing is selected. A value of the basic fuel injection period TiM suitable for each operating state is calculated from one of the four maps corresponding to the operative state of the bypass valve and the valve timing.

Alternatively, the TiM map may be comprised, e.g. of a single map, and a correction coefficient may be stored in the memory means 5*c*, which is set to values corresponding to the operating states of the bypass valve 11 and the valve timing changeover mechanism 30. A value of the basic fuel injection period TiM read from the TiM map is corrected by the correction coefficient.

TiCR represents a basic fuel injection period for use in the starting mode, which is determined according to the engine rotational speed NE and the intake pipe absolute pressure PBA, similarly to the TiM value. A TiCR map for determining the TiCR value is stored in the memory means 5*c* (ROM), as well.

KCMDM represents a modified desired air-fuel ratio coefficient, which is set based on a desired air-fuel ratio coefficient KCMD determined based on operating conditions of the engine, and an air-fuel ratio correction value ΔKCMD determined based on an output from the MO2 sensor 22, as will be described later.

KLAF represents an air-fuel ratio correction coefficient, which is set such that the air-fuel ratio detected by the LAF sensor 21 becomes equal to a desired air-fuel ratio set by the KCMDM value during the air-fuel ratio feedback control, and set to predetermined values depending on operating conditions of the engine during the open-loop control.

K1 and K3 represent other correction coefficients and K2 and K4 represent correction variables. The correction coefficients and variables are set depending on operating conditions of the engine to such values as will optimize operating characteristics of the engine, such as fuel consumption and engine accelerability.

Figure 2:
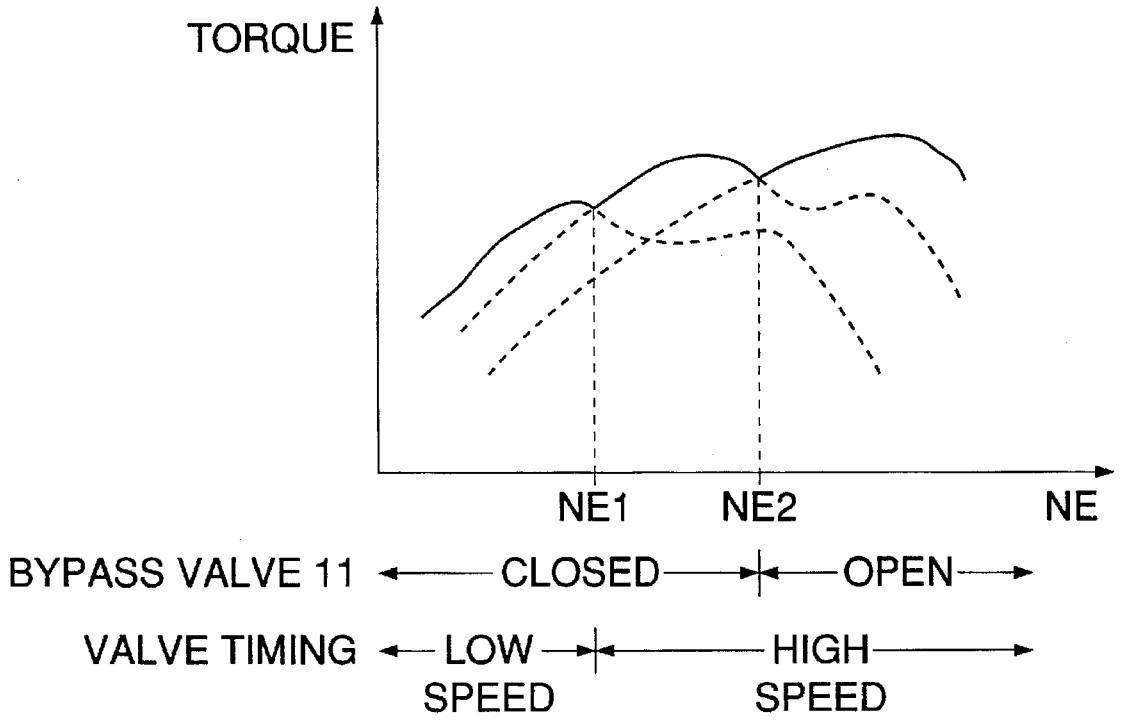
FIG. 2 shows output torque characteristics of the engine obtained when the intake passage and the valve timing of the engine are changed, according to the air-fuel ratio control system shown in FIG. 1.

The CPU 5*b* further calculates the ignition timing of the engine 1, based on operating conditions of the engine, outputs an ignition command signal indicative of the calculated ignition timing, and controls the bypass valve 11 and the valve timing. According to the present embodiment, as shown in FIG. 2, the CPU 5*b* controls the bypass valve 11 and the valve timing according to the engine rotational speed NE. More specifically, in a region where NE<NE1 stands, the aforesaid first operating state is selected, in a region where NE1≦NE<NE2 stands, the aforesaid third operating state is selected, and in a region where NE2≦NE stands, the aforesaid fourth operating state is selected. Thus, as indicated by the solid line curve in FIG. 2, the maximum output torque can be obtained in each region of the engine rotational speed.

In the example shown in FIG. 2, the aforesaid second operating state, i.e. the state where the bypass valve 11 is open and the low-speed valve timing is not selected. However, it may be constructed such that all the four operating states are selected. Even in the case where the output torque is controlled as shown in FIG. 2, the second operating state can stand due to failure of the bypass valve 11 and/or the valve timing changeover mechanism, and therefore the TiM map and maps for determining feedback control constants, described hereinafter, are each comprised of four maps corresponding, respectively, to the first to fourth operating states.

Next, description will be made of a manner of carrying out the air-fuel ratio feedback control by the CPU 5b according to the present embodiment.

Figure 3:
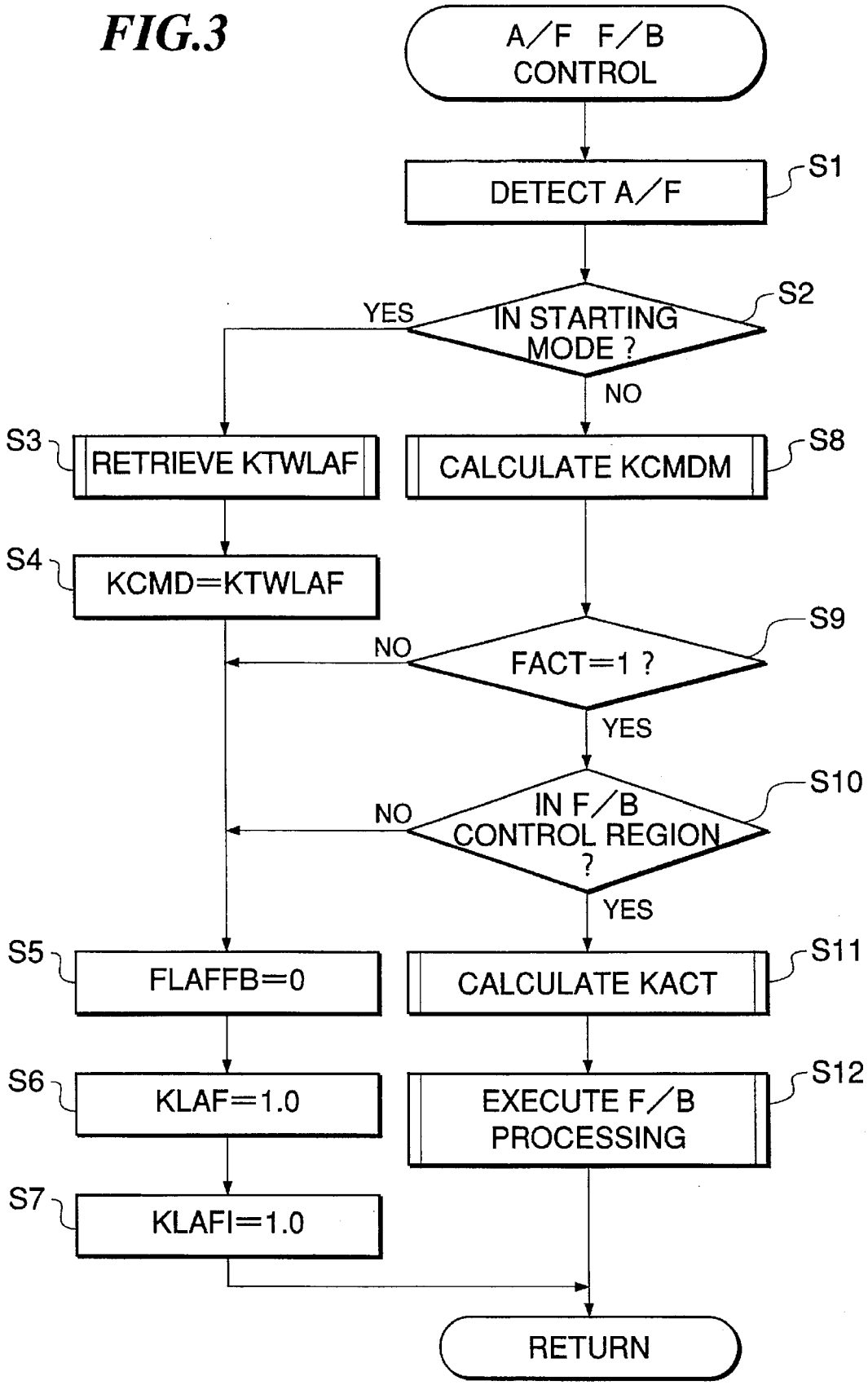
FIG. 3 is a flowchart showing a main routine for carrying out air-fuel ratio feedback control of a mixture supplied to the engine.

FIG. 3 shows a main routine for carrying out the air-fuel ratio feedback control.

First, at a step S1, an output value from the LAF sensor 21 is read in. Then, at a step S2, it is determined whether or not the engine is in the starting mode. The determination as to the starting mode is carried out by determining whether or not a starter switch, not shown, of the engine has been turned on and at the same time the engine rotational speed NE is below a predetermined value (cranking speed).

If the answer to the question of the step S2 is affirmative (YES), i.e. if the engine is in the starting mode, generally the engine coolant temperature is low, and therefore a desired air-fuel ratio coefficient KTWLAF suitable for low engine coolant temperature is determined at a step S3 by retrieving a KTWLAF map according to the engine coolant temperature TW and the intake pipe absolute pressure PBA. The determined KTWLAF value is set to the desired air-fuel ratio coefficient KCMD at a step S4. Then, a flag FLAFFB is set to "0" at a step S5 to inhibit execution of the air-fuel ratio feedback control, and the air-fuel ratio correction coefficient KLAF and an integral term (I term) KLAFI thereof are set to 1.0 at respective steps S6 and S7, followed by terminating the program.

On the other hand, if the answer at the step S2 is negative (NO), i.e. if the engine is in the basic operating mode, the modified desired air-fuel ratio coefficient KCMDM is determined at a step S8 according to a KCMDM-determining routine, described hereinafter with reference to FIG. 4, and then it is determined at a step S9 whether or not a flag FACT is set to "1" to determine whether or not the LAF sensor 21 has been activated. The determination as to whether the LAF sensor 21 has been activated is carried out according to an LAF sensor activation-determining routine, not shown, which is executed as background processing. For example, according to the routine, when the difference between an output voltage value VOUT from the LAF sensor 21 and a predetermined central voltage value VCENT thereof is smaller than a predetermine value (e.g. 0.4 V), it is determined that the LAF sensor 21 has been activated.

If the answer at the step S9 is negative (NO), the program proceeds to the step S5, whereas if the answer is affirmative (YES), i.e. if the LAF sensor 21 has been activated, it is determined at a step S10 whether or not the engine is operating in a region where the air-fuel ratio feedback control is to be carried out based on an output from the LAF sensor 21. If the answer is negative (NO), the program proceeds to the step S5, whereas if the answer is affirmative (YES), the program proceeds to a step S11, wherein an equivalent ratio KACT (equivalent ratio KACT (14.7/(A/F)) of the air-fuel ratio (hereinafter referred to as "the detected air-fuel fuel ratio coefficient") detected by the LAF sensor 21 is calculated. The detected air-fuel ratio coefficient KACT is calculated to a value which is corrected based on the intake pipe absolute pressure PBA, the engine rotational speed NE, and the atmospheric pressure PA, in view of the fact that the pressure of exhaust gases varies with these operating parameters of the engine. Specifically, the detected air-fuel ratio coefficient KACT is determined by executing a KACT-calculating routine, not shown.

Then, at a step S12, a feedback processing routine is executed, followed by terminating the program.

Figure 4:
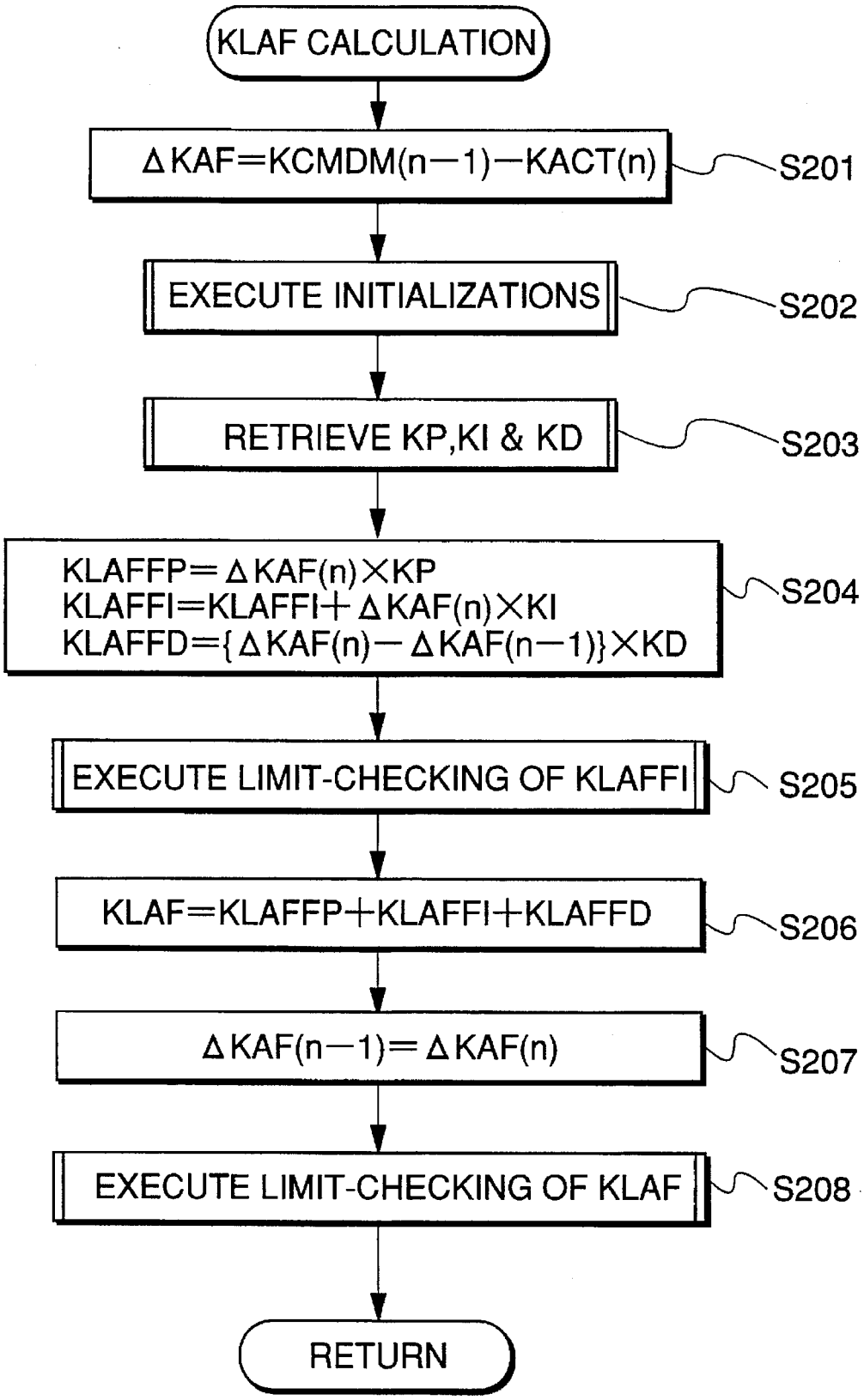
FIG. 4 is a flowchart showing a subroutine for determining an air-fuel ratio correction coefficient KLAF, which is executed by the FIG. 3 routine.

FIG. 4 shows a KLAF-determining routine which is executed at the step S12 in FIG. 3, in synchronism with generation of TDC signal pulses.

First, at a step S201, a calculation is made of a value of the difference ΔKAF between a modified desired air-fuel ratio coefficient KCMDM(n−1) determined in the last loop and a detected air-fuel ratio coefficient KACT(n) determined in the present loop.

At a step S202, initializations of the air-fuel ratio correction coefficient KLAF, etc. are executed. More specifically, the air-fuel ratio correction coefficient KLAF, etc. are initialized according to an initialization routine, not shown, based on the operating condition of the engine.

Then, at a step S203, a KP map, a KI map, and a KD map, none of which is shown, are retrieved to determine the control speed of the air-fuel ratio feedback control, i.e. a proportional term (P term) coefficient KP, an integral term (I term) coefficient KI, and a differential term (D term) coefficient KD. The KP map, KI map, and KD map are each set such that predetermined map values of the respective term coefficients are provided in a manner corresponding to regions defined by predetermined values of the engine rotational speed NE, the intake pipe absolute pressure PBA, etc. By retrieving these maps, map values suitable for the engine operating condition are determined, or additionally by interpolation, if required. The KP, KI and KD maps each consist of a plurality of maps stored in the memory means 5c (ROM) to be selected for exclusive use in respective different operating conditions of the engine, such as a steady operating condition, a change in operating mode, and a decelerating condition so that the optimal map values can be obtained.

Further, the KP map, KI map, and KD map for exclusive use in each engine operating condition, each consist of four maps to be selected according to the aforesaid four operating states determined by the bypass valve 11 and the valve timing changeover mechanism 30. This contemplates the fact that the air intake characteristics of the engine vary depending on selection of the four operating states, whereby the transfer delay of exhaust gases is changed even if the engine is operating in the same operating condition. More specifically, when the high-speed valve timing is selected, the transfer delay of exhaust gases decreases relative to the transfer delay of exhaust gases assumed when the low-speed valve timing is selected, and therefore map values for the high-speed valve timing are each set larger than a corresponding map value for the low-speed valve timing. Further, with respect to the intake passage selected by the bypass valve 11, when the high-speed passage is selected, the transfer delay of exhaust gases decreases relative to the transfer delay assumed when the low-speed passage is selected, and therefore map values for the high-speed passage are each set larger than a corresponding map value for the low-speed passage.

The tendency of setting map values mentioned above is applicable only to representative values. For example, when the engine is operating under such an exceptional condition that the rotational speed is low while the high-speed valve timing or the high-speed passage is selected, the intake efficiency ηV is degraded, resulting in an increased amount of the transfer delay of exhaust gases. Therefore, map values under the above exceptional condition are each set smaller than a corresponding map value for the low-speed valve timing or the low-speed passage.

In an engine having a bypass passage in the exhaust passage 18, which bypasses the first catalytic converter 19, and an exhaust passage bypass valve which changes the passage of exhaust gases between one flowing through the bypass passage and one flowing through the first catalytic converter 19, the pressure of exhaust gases changes due to changeover of the exhaust gas passage, and consequently air intake characteristics of the engine change. Therefore, further maps are required for each of the KP, KI, and KD maps so as to cope with the changeover of the exhaust gas passage, i.e. a map for use when the passage of exhaust gases flowing through the bypass passage is selected and a map for use when the passage of exhaust gases flowing through the catalytic converter is selected.

Similarly to the TiM map, the KP, KI, and KD maps may be each comprised of a single map, and each of the read KP, KI, and KD values may be corrected according to the operative states of the bypass valve 11 and the valve timing changeover mechanism 30 to obtain KP, KI, and KD values suitable for the operative states.

Then, at a step S204, calculations are made of a P term KLAFFP, an I term KLAFFI, and a D term KLAFFD, by the use of the following respective equations (3) to (5):

$$KLAFFP=\Delta KAF(n)\times KP \quad (3)$$

$$KLAFFI=KLAFFI+\Delta KAF(n)\times KI \quad (4)$$

$$KLAFFD=(\Delta KAF(n)-\Delta KAF(n-1))\times KD \quad (5)$$

At a step S205, limit-checking of the I term KLAFFI calculated as above is executed. More specifically, the KLAFFI value is compared with predetermined upper and lower limit values LAFFIH and LAFFIL, and if the KLAFFI value is larger than the upper limit value LAFFIH, the KLAFFI value is set to the upper limit value LAFFIH, whereas if the KLAFFI value is smaller than the lower limit value LAFFIL, the KLAFFI value is set to the lower limit value LAFFIL.

At a step S206, the air-fuel ratio correction coefficient KLAF is calculated by adding together the P term KLAFFP, the I term KLAFFI, and the D term KLALFFD, and then at a step S207, a value ΔKLAF(n) of the difference ΔKLAF calculated in the present loop is set as a value ΔKLAF($n$−1) calculated in the last loop.

Then, at a step S208, limit-checking of the KLAF value calculated as above is executed, followed by terminating the present program.

The rate of execution of the present program may be thinned out depending on operating conditions of the engine, if required, such that the KLAF value is updated once per generation of several TDC signal pulses.

Figure 5:
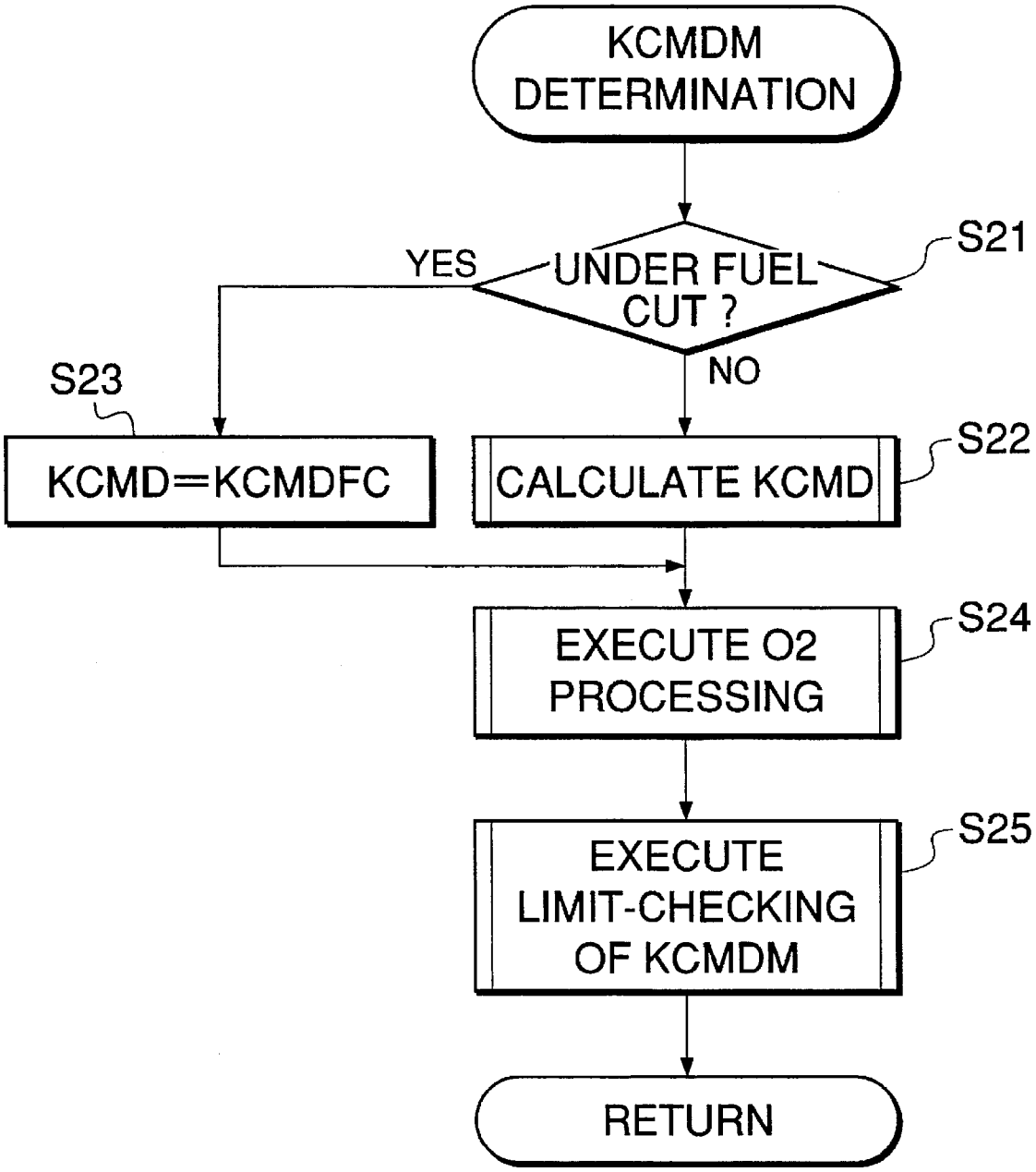
FIG. 5 is a flowchart showing a subroutine for determining a modified desired air-fuel ratio coefficient KCMDM, which is executed by the FIG. 3 routine.

FIG. 5 shows details of the aforementioned KCMDM-determining routine which is executed at the step S8 in FIG. 3, in synchronism with generation of TDC signal pulses.

First, it is determined at a step S21 whether or not the engine is under fuel cut, i.e. fuel supply has been interrupted. The determination as to fuel cut is carried out based on the engine rotational speed NE and the valve opening θTH of the throttle valve 3', and more specifically it is carried out by a fuel cut-determining routine, not shown.

If the answer at the step S21 is negative (NO), i.e. if the engine is in the basic operating mode, the program proceeds to a step S22, wherein the desired air-fuel ratio coefficient KCMD is determined. The desired air-fuel ratio coefficient KCMD is normally read from a KCMD map according to the engine rotational speed NE and the intake pipe absolute pressure PBA, which map is set such that predetermined KCMD map values are provided correspondingly to predetermined values of the engine rotational speed NE and those of the intake pipe absolute pressure PBA. At standing start of a vehicle with the engine installed thereon, or when the engine coolant temperature is low, or when the engine is in a predetermined high load condition, the map value read is corrected to a suitable value, specifically by executing a KCMD-determining routine, not shown. The program then proceeds to a step S24.

On the other hand, if the answer at the step S21 is affirmative (YES), the desired air-fuel ratio coefficient KCMD is set to a predetermined value KCMDFC (e.g. 1.0) at a step S23, and then the program proceeds to the step S24.

At the step S24, 02 processing is executed. More specifically, the desired air-fuel ratio coefficient KCMD is corrected based on the output from the MO2 sensor 22 to obtain the modified desired air-fuel ratio coefficient KCMDM, under predetermined conditions, as will be described hereinafter.

Then, at a step S25, limit-checking of the modified desired air-fuel ratio coefficient KCMDM calculated as above is carried out, followed by terminating the present subroutine to return to the main routine of FIG. 2. More specifically, the KCMDM value calculated at the step S24 is compared with predetermined upper and lower limit values KCMDMH and KCMDML, and if the KCMDM value is larger than the predetermined upper limit value KCMDMH, the former is set to the latter, whereas if the KCMDM value is smaller than the predetermined lower limit value KCMDML, the former is set to the latter.

Figure 6:
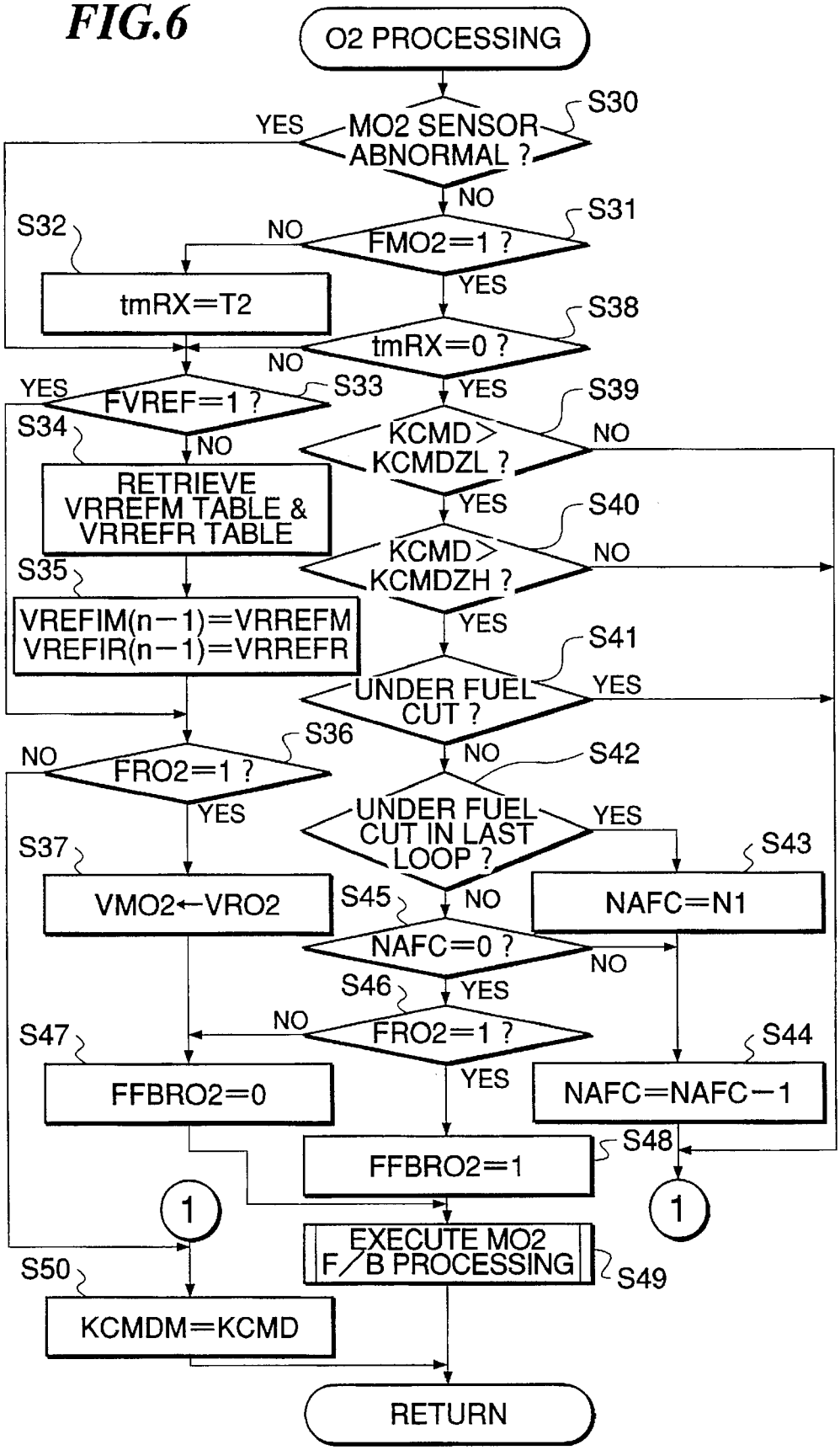
FIG. 6 is a flowchart showing a subroutine for carrying out 02 processing, which is executed by the FIG. 5 routine.

FIG. 6 shows an O2 processing routine which is executed at the step S24 in FIG. 5, in synchronism with generation of TDC signal pulses.

First, it is determined at a step S30 whether or not an abnormality of the MO2 sensor 22 has been detected, and if an abnormality has been detected, the program jumps to a step S33. On the other hand, if no abnormality has been detected, it is determined at a step S31 whether or not a flag FMO2 is set to "1", to determine whether or not the MO2 sensor 22 has been activated. The determination as to activation of the MO2 sensor 22 is carried out, specifically by executing an MO2 sensor activation-determining routine shown in FIG. 7, as background processing.

Figure 7:
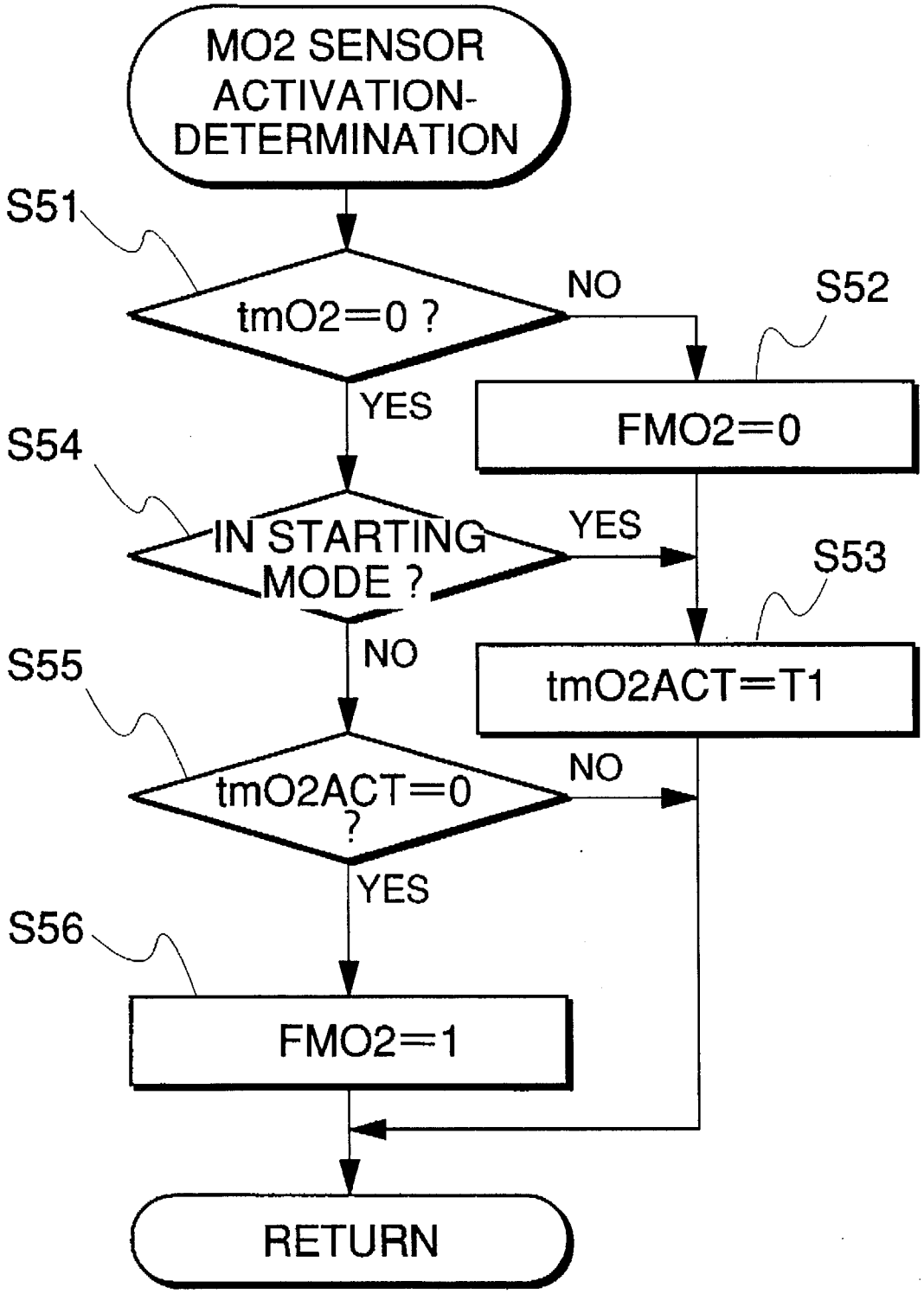
FIG. 7 is a flowchart showing an MO2 sensor activation-determining routine, which is executed by the FIG. 6 routine.

Referring to FIG. 7, first it is determined at a step S51 whether or not the count value of an activation-determining timer tmO2, which is set to a predetermined value (e.g. 2.56 sec.) when an ignition switch, not shown, of the engine is turned on, is equal to "0". If the answer is negative (NO), it is judged that the MO2 sensor 22 has not been activated yet, and then the flag FMO2 is set to "0" at a step S52, and an O2 sensor forcible activation timer tmO2ACT is set to a predetermined value T1 (e.g. 2.56 sec.) and started, at a step S53, followed by terminating the program.

On the other hand, if the answer at the step S51 is affirmative (YES), it is determined at a step S54 whether or not the engine is in the starting mode. If the answer is affirmative (YES), the program proceeds to the step S53, wherein the forcible activation timer tmO2ACT is set to the predetermined value T1 and started, followed by terminating the program.

If the answer at the step S54 is negative (NO), the program proceeds to a step S55, wherein it is determined whether or not the count value of the forcible activation timer tmO2ACT is equal to "0". If the answer is negative (NO), the present program is immediately terminated, whereas if the answer is affirmative (YES), it is judged that the MO2 sensor 22 has been activated, and therefore the flag FMO2 is set to "1" at a step S56, followed by terminating the program.

Determination as to activation of the RO2 sensor 23 is carried out similarly to the processing of FIG. 7, and if the RO2 sensor 23 has been activated, a flag FRO2 is set to "1".

In this connection, when the engine is under fuel cut, or a predetermined time period has not elapsed after termination of fuel cut, the flag FRO2 remains set to "0" even after the completion of activation of the RO2 sensor 23.

After the execution of the MO2 sensor activation-determining routine shown in FIG. 7, if the answer at the step S31 in FIG. 6 is negative (NO), i.e. if the MO2 sensor 22 has not been activated yet, the program proceeds to a step S32, wherein a timer tmRX is set to a predetermined value T2 (e.g. 0.25 sec.), and then it is determined at a step S33 whether or not a flag FVREF is set to "1" to determine whether or not integral terms VREFIM(n−1) and VREFIR (n−1), referred to hereinafter, have been set.

In the first loop of execution of the routine, the answer at the step S33 is negative (NO), and then the program proceeds to a step S34, wherein a VRREFM table and a VRREFR table stored in the memory means 5c (ROM) are retrieved to determine a reference value VRREFM for an output voltage VMO2 from the MO2 sensor 22 and a reference value VRREFR for an output voltage VRO2 from the RO2 sensor 23, respectively.

Figure 8A:
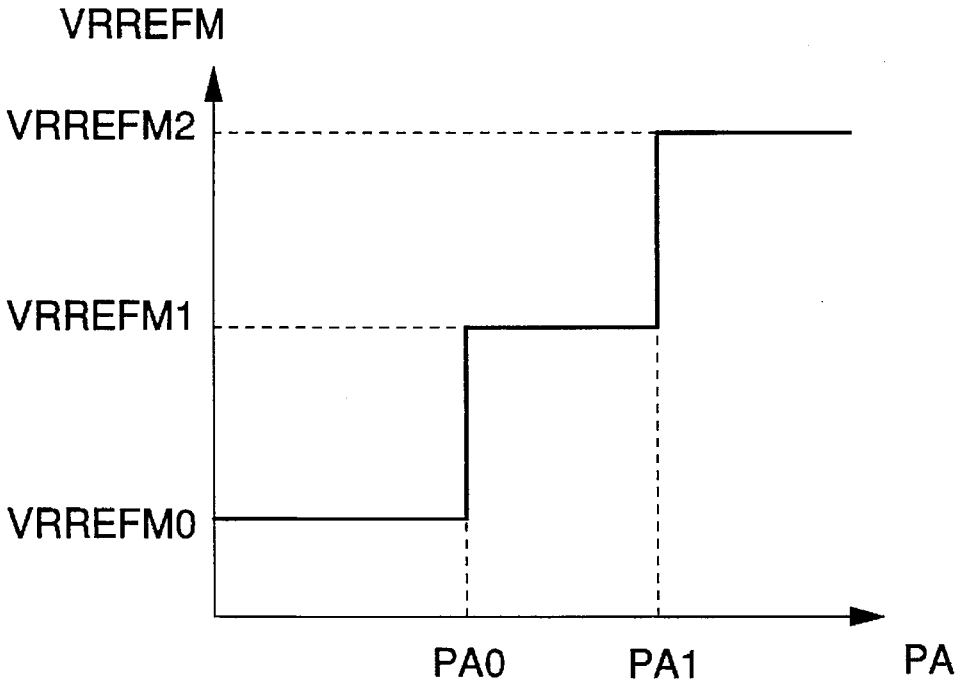
FIG. 8A shows a VRREFM table.
Figure 8B:
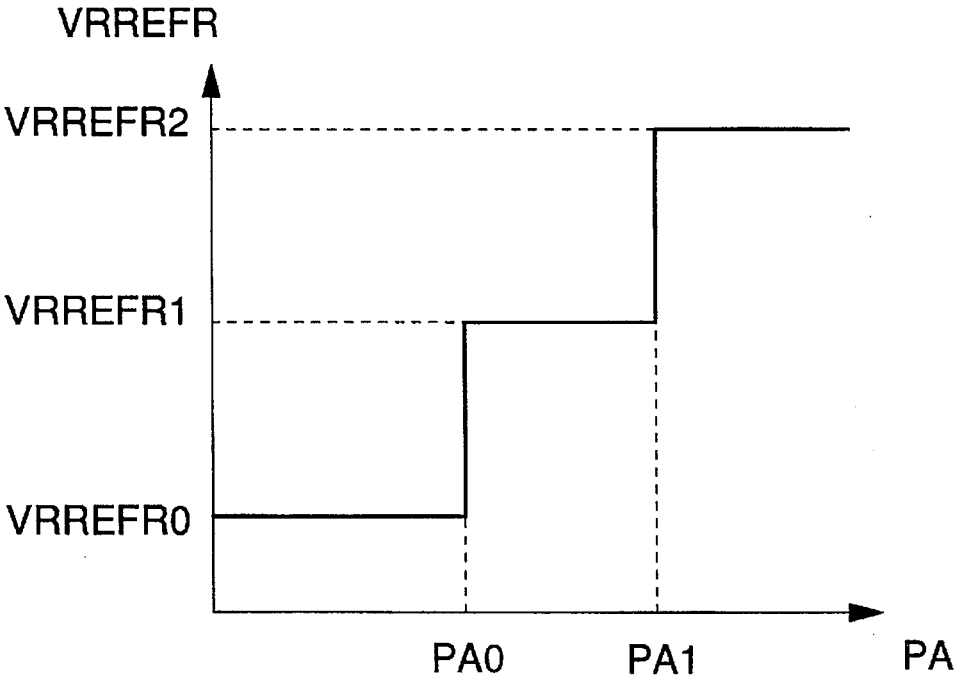
FIG. 8B shows a VRREFR table.

The VRREFM table is set, as shown in FIG. 8A, such that table values VRREFM0 to VRREFM2 are provided in a manner corresponding to predetermined values PA0 to PA1 of the atmospheric pressure PA detected by the PA sensor 24. The reference value VRREFM is determined by retrieving the VRREFM table, or additionally by interpolation, if required. The VRREFR table is set, as shown in FIG. 8B, similarly to the VRREFM table, and the reference value VRREFR is determined by retrieving the VRREFR table. As is clear from FIGS. 8A and 8B, both the reference values VRREFM and VRREFR are set to larger values as the atmospheric pressure PA assumes a higher value.

Then, at a step S35, the integral terms (I term) VREFIM (n−1) and VREFIR(n−1) are set to the reference values VRREFM and VRREFR determined at the step S34, respectively, followed by the program proceeding to a step S36. Thus, the I terms VREFIM(n−1) and VREFIR(n−1) have been initialized, and then the program proceeds to the step S36. After the I terms have been initialized, the flag FVREF is set to "1", though not shown. When the step S33 is executed in the following loops, the answer at the step S33 is affirmative (YES), so that the program jumps over the steps S34 and S35 to the step S36.

At the step S36, it is determined whether or not the flag FRO2 is set to "1" to determine whether or not the RO2 sensor 23 has been activated, the engine is under fuel cut, or the aforementioned predetermined time period has not elapsed after the termination of fuel cut. If FRO2≠1 holds, the modified desired air-fuel ratio coefficient KCMDM is set to the desired air-fuel ratio coefficient KCMD as it is, at a step S50, followed by terminating the program.

On the other hand, if FRO2=1 holds, the output VMO2 from the MO2 sensor is replaced by the output VRO2 from the RO2 sensor at a step S37, and then a flag FFBRO2 is set to "0" at a step S47, followed by the program proceeding to a step S49. By this processing, when the MO2 sensor 22 is in an abnormal state or has not been activated yet and at the same time the RO2 sensor 23 has been activated, the output VRO2 from the RO2 sensor is substituted for the output VMO2 from the MO2 sensor. On this occasion, a thinning-out variable NIVRM, hereinafter referred to, to be employed during execution of MO2 feedback processing executed at the step S49 may be changed to a predetermined value employed when the VRO2 value is substituted for the VMO2 value. Further, by setting the flag FFBRO2 to 0, RO2 feedback processing carried out during execution of the MO2 feedback processing at the step S49, hereinafter described, is inhibited (see steps S74 and S75 in FIG. 9). At the step S49, the MO2 feedback processing is executed based on the output VMO2 from the MO2 sensor 22.

Referring again to the step S31, if the answer at the step S31 is affirmative (YES), it is judged that the MO2 sensor 22 has been activated, and then the program proceeds to a step S38, wherein it is determined whether or not the count value of the timer tmRX is equal to "0". If the answer is negative (NO), the program proceeds to the step S33, whereas if the answer is affirmative (YES), it is judged that the MO2 sensor 22 has been activated. Then, the program proceeds to a step S39, wherein it is determined whether or not the desired air-fuel ratio coefficient KCMD set at the step S22 or S23 in the FIG. 5 routine is larger than a predetermined lower Limit value KCMDZL (e.g. 0.98). If the answer is negative (NO), which means that the air-fuel ratio of the mixture has been controlled to a value suitable for a so-called "lean burn" condition of the condition, and then the program proceeds to a step S50, whereas if the answer is affirmative (YES), the program proceeds to a step S40, wherein it is determined whether or not the desired air-fuel ratio coefficient KCMD is smaller than a predetermined upper limit value KCMDZH (e.g. 1.13). If the answer is negative (NO), which means that the air-fuel ratio of the mixture has been controlled to a rich value, and then the program proceeds to the step S50, whereas if the answer is affirmative (YES), which means that the air-fuel ratio of the mixture is to be controlled to the stoichiometric value (A/F=14.7), the program proceeds to a step S41, wherein it is determined whether or not the engine is under fuel cut. If the answer is affirmative (YES), the program proceeds to the step S50, whereas if the answer is negative (NO), it is determined at a step S42 whether or not the engine was under fuel cut in the immediately preceding loop. If the answer is affirmative (YES), the count value of a counter NAFC is set to a predetermined value N1 (e.g. 4) at a step S43, and the count value of the counter NAFC is decremented by "1" at a step S44, followed by the program proceeding to the step S50.

On the other hand, if the answer at the step S42 is negative (NO), the program proceeds to a step S45, wherein it is determined whether or not the count value of the counter NAFC is equal to "0". If the answer is negative (NO), the count value of the counter NAFC is decremented by "1" at the step S44, followed by terminating the program. On the other hand, if the answer is affirmative (YES), it is judged that the fuel supply has been stabilized after termination of fuel cut, and then the program proceeds to a step S46, wherein it is determined whether or not FRO2=1 holds. If FRO2=0 holds, indicating that the RO2 sensor has not been activated yet, the program proceeds to the step S47. On the other hand, if FRO2=1 holds, indicating that the RO2 sensor has been activated, the flag FFBRO2 is set to "1" at a step S48, and then the MO2 feedback processing is carried out at the step S49, followed by the program returning to the main routine of FIG. 3.

FIG. 9 shows an MO2 feedback processing routine which is executed at the step S49 in the FIG. 6 routine, in synchronism with generation of TDC signal pulses.

First, at a step S61, it is determined whether or not the thinning-out variable NIVRM is equal to "0" The thinning-out variable NIVRM is a variable which is subtracted by a thinning-out TDC number NIM which is determined based on operating conditions of the engine, whenever a TDC signal pulse is generated, as will be described later. In the first loop of execution of the program, the answer is affirmative (YES), and then the program proceeds to a step S74.

If the answer at the step S61 becomes negative (NO) in a subsequent loop, the program proceeds to a step S70.

The thinning-out variable NIVRM is provided in order that the feedback control based on the output from the LAF sensor is carried out as a main control and the feedback based on the output from the MO2 sensor as a subordinate control to prevent occurrence of hunting, etc. and improve the controllability of the air-fuel ratio. The value of the thinning-out variable NIVRM is set depending on the volume of the first catalytic converter 19, the mounting locations of the LAF sensor 21 and the MO2 sensor 22, and operating conditions of the engine. However, if there is no fear that hunting occurs, the present routine may be executed in synchronism with execution of the feedback control based on the output from the LAF sensor.

At the step S74, it is determined whether or not the flag FFBRO2 is set to "1" If FFBRO2=0 holds, a correction value ΔVRREFM for the reference value VRREFM of the MO2 sensor output voltage is set to "0" at a step S76, followed by the program proceeding to a step S62. On the other hand, if FFBRO2=1 holds, the RO2 feedback processing for calculating the correction value ΔRREFR, based on the output VRO2 from the RO2 sensor is executed at a step S75, followed by the program proceeding to the step S62.

Figure 10A:
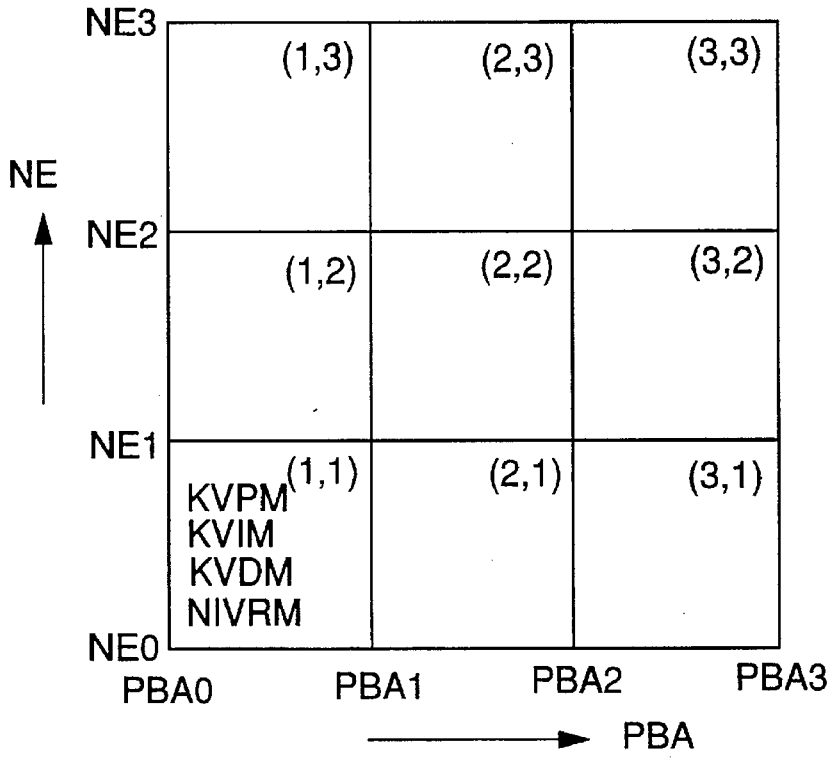
FIG. 10A shows NE-PBA maps which are used for calculating feedback control constants and a thinning-out variable used for the feedback control based on the MO2 sensor.

At the step S62, a KVPM map, a KVIM map, a KVDM map, and an NIVRM map are retrieved to determine a rate of change in the O2 feedback control, i.e. a proportional term (P term) coefficient KVPM, an integral term (I term) coefficient KVIM, a differential term (D term) coefficient KVDM, and the above-mentioned thinning-out variable NIVRM. The KVPM map, the KVIM map, the KVDM map, and the NIVRM map are set, e.g. as shown in FIG. 10A, such that predetermined map values for the respective coefficients KVPM, KVIM and KVDM and the variable NIVRM are provided in a manner corresponding to regions (1,1) to (3,3) defined by predetermined values NE0 to NE3 of the engine rotational speed NE and predetermined values PBA0 to PBA3 of the intake pipe absolute pressure PBA. By retrieving these maps, map values suitable for engine operating conditions are determined, or additionally by interpolation, if required. These KVPM, KVIM, KVDM, and NIVRM maps each consist of a plurality of maps stored in the memory means 5*c* (ROM) to be selected for exclusive use in respective different operating conditions of the engine, such as a steady operating condition, a change in operating mode, and a decelerating condition so that the optimum map values can be obtained.

Further, similarly to the aforementioned KP map, KI map and KD map, the KVPM map, KVIM map, KVDM map, and NIVRM map for exclusive use in each engine operating condition, each consist of four maps to be selected according to the aforesaid four operating states determined by the bypass valve 11 and the valve timing changeover mechanism 30. This contemplates the fact that air intake characteristics of the engine vary depending on selection of the four operating states, whereby the transfer delay of exhaust gases is changed even if the engine is operating in the same operating conditions. More specifically, when the high-speed valve timing is selected, the transfer delay of exhaust gases decreases relative to the transfer delay of exhaust gases assumed when the low-speed valve timing is selected, and therefore map values of the KVPM map, KVIM map, and KVDM map for the high-speed valve timing are each set larger than a corresponding map value for the low-speed valve timing, while a map value of the NIVRM map for the high-speed valve timing is set smaller than a corresponding map value for the low-speed valve timing. Further, with respect to the intake passage selected by the bypass valve 11, when the high-speed passage is selected, the transfer delay of exhaust gases decreases relative to the transfer delay assumed when the low-speed passage is selected, and therefore map values of the KVPM map, KVIM map, and KVDM map for the high-speed passage are each set larger than a corresponding map value for the low-speed passage, while a map value of the NIVRM map for the high-speed passage is set smaller than a corresponding map value for the low-speed passage.

The tendency of setting map values mentioned above is applicable only to representative values. For example, when the engine is operating under such an exceptional condition that the rotational speed is low while the high-speed valve timing or the high-speed passage is selected, the intake efficiency ηV is degraded, resulting in an increased amount of the transfer delay of exhaust gases. Therefore, under the above exceptional condition, map values of the KVPM map, KVIM map, and KVDM map are each set smaller than a corresponding map value for the low-speed valve timing or the low-speed passage, while a map value of the NIVRM map is set larger than a corresponding map value for the low-speed valve timing or the low-speed passage.

Similarly to the KP map, etc., the KVPM map, KVIM map and KVDM map may be provided in increased numbers according to changeover of the exhaust passage in an engine having a bypass passage in the exhaust passage 18, or alternatively, instead of increasing the numbers of the maps, the map values may be corrected according to the operative states of the bypass valve 11 and the valve timing changeover mechanism 30 to obtain the KVPM, KVIM, and KVDM values suitable for the operative states.

Then, at a step S63, the thinning-out variable NIVRM is set to a value determined at the step S62, and similarly to the step S34 in FIG. 6, a VRREFM table is retrieved to calculate the reference value VRREFM for the MO2 sensor output voltage, at a step S64. Then, at a step S65, a correction is made by adding the correction value ΔVRREFM to the reference value VRREFM, by the use of the following equation (6), and a calculation is made of a value ΔVM(n) of the difference between the reference value VRREFM after the correction and the output voltage VMO2 from the MO2 sensor 22 in the present loop, by the use of the following equation (7):

$$VRREFM=VRREFM+\Delta VRREFM \quad (6)$$

$$AVM(n)=VRREFM-VMO2 \quad (7)$$

Then, at a step S66, desired correction values VREFPM (n), VREFIM(n), and VREFDM(n) for the respective correction terms, i.e. P term, I term, and D term, are calculated by the use of the following equations (8) to (10):

$$VREFPM(n)=\Delta VM(n)\times KVPM \quad (8)$$

$$VREFIM(n)=VREFIM(n-1)+\Delta VM(n)\times KVIM \quad (9)$$

$$VREFDM(n)=(\Delta VM(n)-\Delta VM(n-1))\times KVDM \quad (10)$$

Then, these desired correction values are added together by the use of the following equation (11) to determine a desired correction value VREFM(n) of the output voltage VMO2 from the MO2 sensor 22 for use in the MO2 feedback control:

$$VREFM(n)=VREFPM(n)+VREFIM(n)+VREFDM(n) \quad (11)$$

Figure 11:
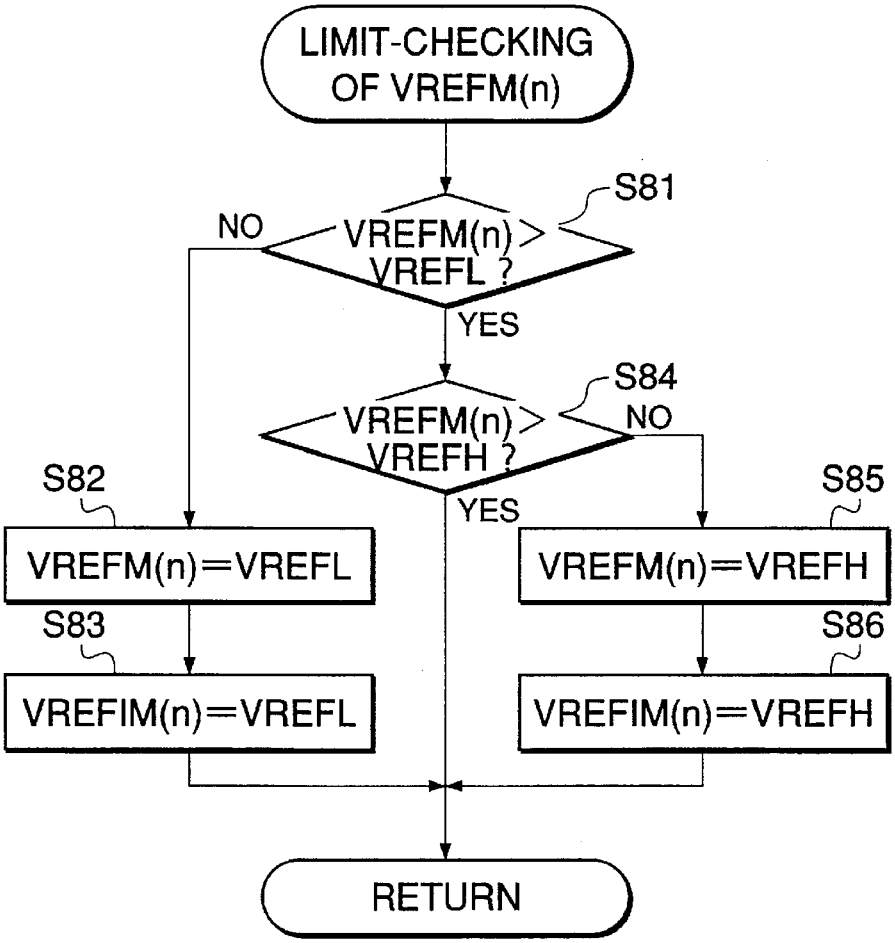
FIG. 11 is a flowchart showing a subroutine for carrying out limit-checking of a desired correction value VREFM(n) of an MO2 sensor output voltage VMO2, which is executed by the FIG. 9 routine.

Then, at a step S67, limit-checking of the desired correction value VREFM(n) calculated as above is carried out. FIG. 11 shows a subroutine for carrying out the limit-checking, which is executed in synchronism with generation of TDC signal pulses.

First, at a step S81, it is determined whether or not the desired correction value VREFM(n) is larger than a predetermined lower limit value VREFL (e.g. 0.2 V). If the answer is negative (NO), the desired correction value VREFM(n) and the I term desired correction value VREFIM (n) are set to the predetermined lower limit value VREFL at respective steps S82 and S83, followed by terminating this program.

On the other hand, if the answer at the step S81 is affirmative (YES), it is determined at a step S84 whether or not the desired correction value VREFM(n) is smaller than a predetermined upper limit value VREFH (e.g. 0.8 V). If the answer is affirmative (YES), the desired correction value VREFM(n) falls within a range defined by the predetermined upper and lower limit values VREFH and VREFL, and then the present routine is terminated without modifying the VREFM(n) value determined at the step S68. On the other hand, if the answer at the step S84 is negative (NO), the desired correction value VREFM(n) and the I term desired correction value VREFIM(n) are set to the predetermined upper limit value VREFH at respective steps S85 and S86, followed by terminating this routine.

Following the limit-checking of the desired correction value VREFM(n), the program returns to the step S68 in the FIG. 9 routine, wherein the air-fuel ratio correction value ΔKCMD is calculated.

Figure 12A:
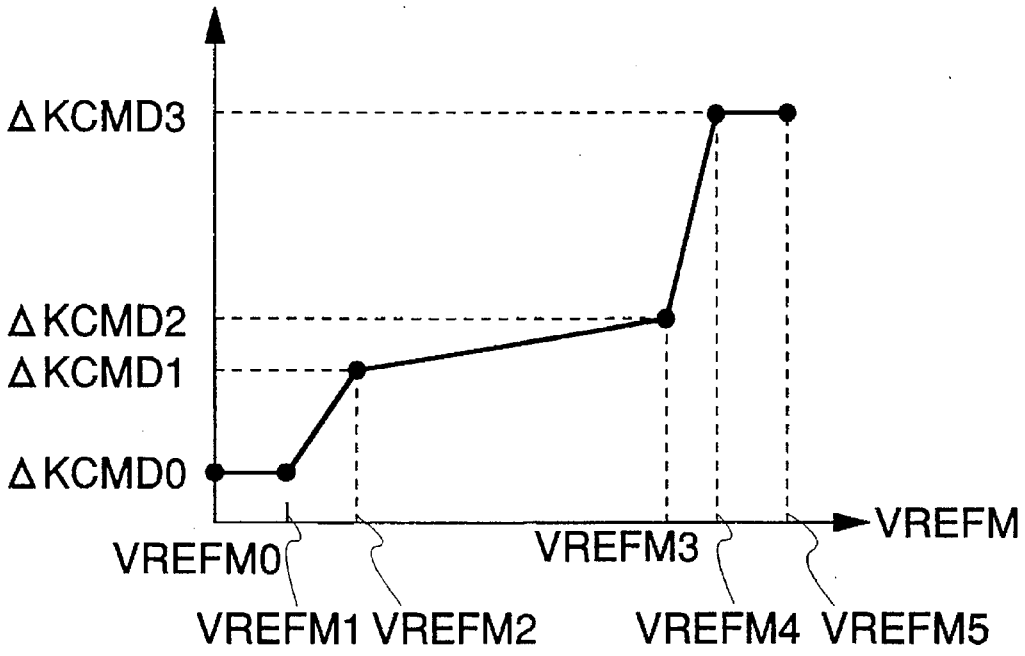
FIG. 12A shows a ΔKCMD table.

The air-fuel ratio correction value ΔKCMD is determined, e.g. by retrieving a ΔKCMD table shown in FIG. 12A. The ΔKCMD table is set such that table values ΔKCMD0 to ΔKCMD3 are provided correspondingly to predetermined values VREFM0 to VREFM5 of the desired correction value VREFM. The air-fuel ratio correction value ΔKCMD is determined by retrieving the ΔKCMD table, or additionally by interpolation, if required. As is clear from FIG. 12A, the ΔKCMD value is generally set to a larger value as the VREFM(n) value assumes a larger value. Further, the VREFM value has been subjected to the limit-checking at the step S67, and accordingly the air-fuel ratio correction value ΔKCMD is also set to a value within a range defined by predetermined upper and lower limit values.

Then, at a step S69, the air-fuel ratio correction value ΔKCMD is added to the desired air-fuel ratio coefficient KCMD calculated at the step S22 in FIG. 5, to thereby calculate the modified desired air-fuel ratio coefficient KCMDM, followed by terminating the program.

If NIVRM>0 holds at the step S61, the count value of the counter NIVRM is decremented by the thinning-out TDC number NIM at a step S70, and then the aforementioned difference ΔVM, the desired correction value VEFM, and the air-fuel ratio correction value Δ KCMD are held at the values assumed in the immediately preceding loop, respectively at steps S71, S72 and S73, followed by the program proceeding to the step S69.

Alternatively, the thinning-out variable NIVRM may be always set to "0" to calculate the modified desired air-fuel ratio coefficient KCMDM by executing the step S62 to S69 in synchronism with generation of each TDC signal pulse.

Figure 13:
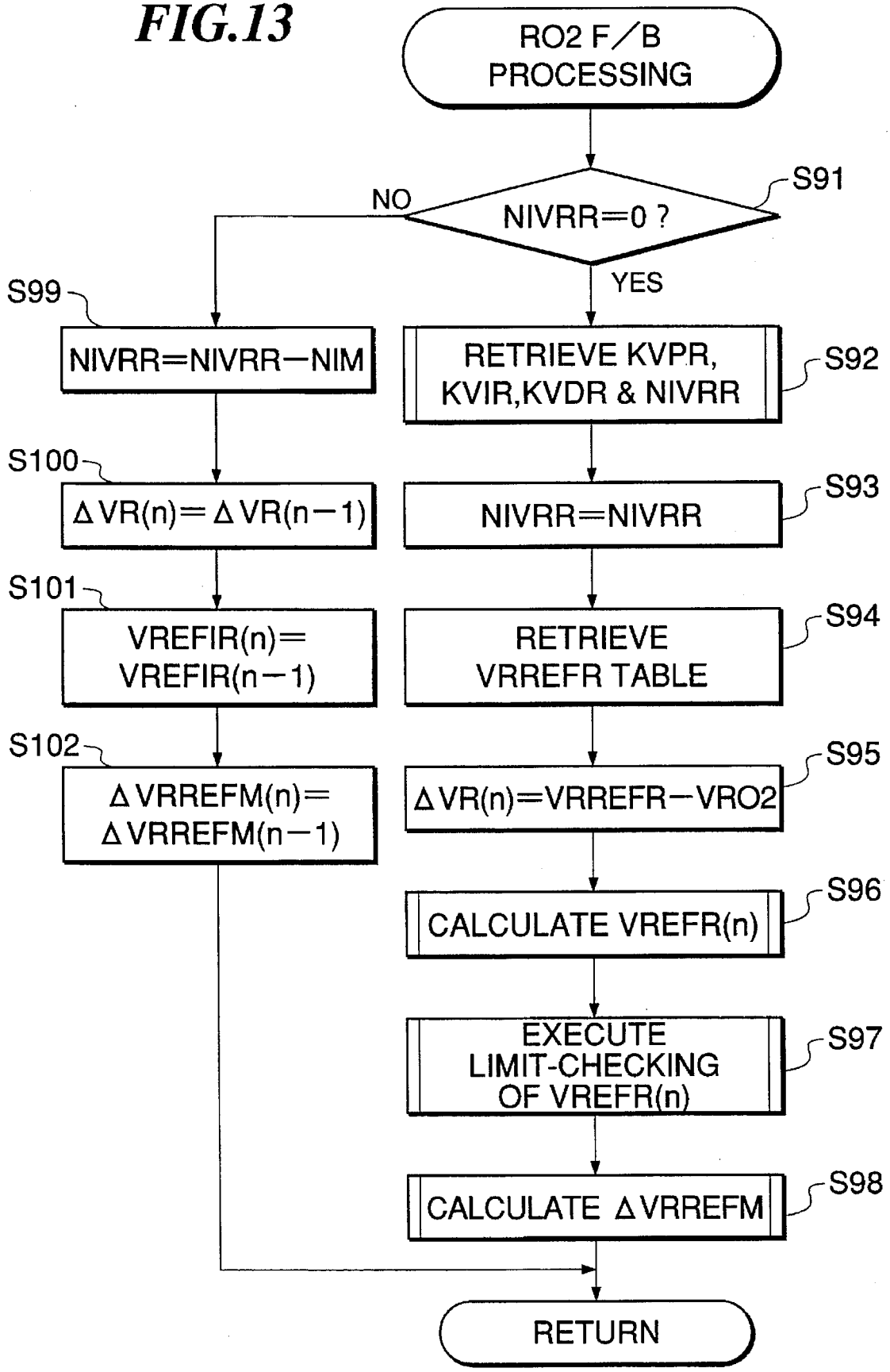
FIG. 13 is a flowchart showing a subroutine for carrying out RO2 feedback control, which is executed by the FIG. 9 routine.

FIG. 13 shows a subroutine for carrying out the RO2 feedback processing which is executed at the step S75 in FIG. 9.

First, at a step S91, it is determined whether or not a thinning-out variable NIVRR is equal to "0". The thinning-out variable NIVRR is similar to the thinning-out variable NIVRM employed in the processing of FIG. 9, which is subtracted by a thinning-out TDC number NIR which is determined based on operating conditions of the engine, whenever a TDC signal pulse is generated. In the first loop of execution of the program, the thinning-out variable NIVRR is equal to "0", i.e. the answer at the step S91 is affirmative (YES), and then the program proceeds to a step S92.

In this respect, the RO2 feedback processing is not carried out during execution of the thinning-out processing (NIVRM ≠0) in the MO2 feedback processing and hence the updating rate of the control constant in the RO2 feedback processing is equal to or less than that of the control constant in the MO2 feedback processing, regardless of the set value of the thinning-out variable NIVRR. This is because the 02 processing of FIG. 6 is executed with the MO2 feedback processing as main processing and with the RO2 feedback processing as subordinate processing, so as to prevent occurrence of hunting, etc. and improve the controllability of the air-fuel ratio.

Figure 10B:
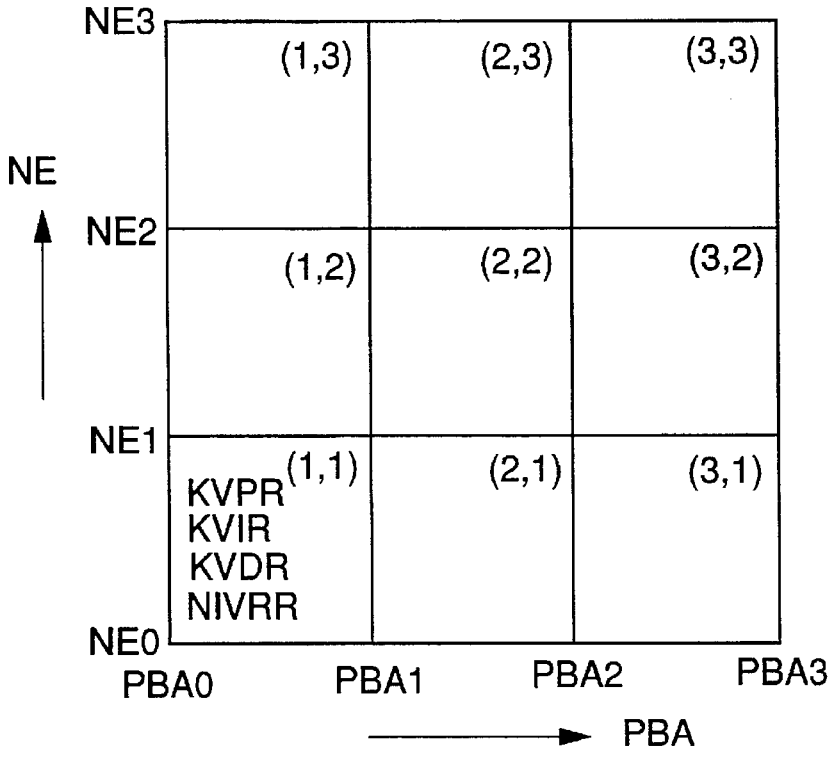
FIG. 10B shows NE-PBA maps which are used for calculating feedback control constants and a thinning-out variable used for feedback control based on an RO2 sensor.

At the step S92, a KVPR map, a KVIR map, a KVDR map, and an NIVRR map are retrieved to determine a rate of change in the O2 feedback control, i.e. a proportional term (P term) coefficient KVPR, an integral term (I term) coefficient KVIR, a differential term (D term) coefficient KVDR, and the aforementioned thinning-out variable NIVRR. The KVPR map, the KVIR map, the KVDR map, and the NIVRR map are set, e.g. as shown in FIG. 10B, such that predetermined map values for the respective coefficients KVPR, KVIR and KVDR and the variable NIVRR are provided in a manner corresponding to regions (1,1) to (3,3) defined by the predetermined values NE0 to NE3 of the engine rotational speed NE and the predetermined values PBA0 to PBA3 of the intake pipe absolute pressure PBA. By retrieving these maps, map values suitable for engine operating conditions are determined, or additionally by interpolation, if required. These KVPR, KVIR, KVDR, and NIVRR maps each consist of a plurality of maps stored in the memory means 5c (ROM) to be selected for exclusive use in respective different operating conditions of the engine, such as a steady operating condition, a change in operating mode, and a decelerating condition so that the optimum map values can be obtained.

Further, similarly to the aforesaid KVPM map, KVIM map, KVDM map, and NIVRM map, the KVPR map, the KVIR map, the KVDR map, and the NIVRR map for exclusive use in each engine operating condition, each consist of four maps according to the four operating states determined by the bypass valve 11 and the valve timing changeover mechanism 30. The tendency of setting map values of the KVPR map, KVIR map, KVDR map, and NIVRR map is similar to that of setting the KVPM map, KVIM map, KVDM map, and NIVRM map.

Similarly to the KP map, etc., the KVPR map, KVIR map and KVDR map may be provided in increased numbers according to changeover of the exhaust passage in an engine having an bypass passage in the exhaust passage 18, or alternatively, instead of increasing the numbers of the maps, the map values may be corrected according to the operative states of the bypass valve 11 and the valve timing changeover mechanism 30 to obtain the KVPR, KVIR, and KVDR values suitable for the operative states.

Then, at a step S93, the thinning-out variable NIVRR is set to the value determined at the step S92, and similarly to the step S34 in FIG. 6, a VRREFR table is retrieved to calculate the reference value VRREFR for the RO2 sensor output voltage, at a step S94. Then, at a step S95, a calculation is made of a value ΔVR(n) of the difference between the reference value VRREFR and the output voltage VRO2 of the RO2 sensor 23, by the use of the following equation (12):

$$\Delta VR(n)=VRREFR-VRO2 \quad (12)$$

Then, at a step S96, desired correction values VREFPR (n), VREFIR(n), and VREFDR(n) for the respective correction terms, i.e. P term, I term, and D term, are calculated by the use of the following equations (13) to (15):

$$VREFPR(n)=\Delta VR(n)\times KVPR \quad (13)$$

$$VREFIR(n)=VREFIR(n-1)+\Delta VR(n)\times KVIR \quad (14)$$

$$VREFDR(n)=(\Delta VR(n)-\Delta VR(n-1))\times KVDR \quad (15)$$

Then, these desired correction values are added together to calculate the desired correction value VREFR(n) for the RO2 feedback processing, by the use of the following equation (16) to determine the desired correction value VREFR(n) of the output voltage VRO2 from the RO2 sensor 23 for use in the RO2 feedback control:

$$VREFR(n)=VREFPR(n)+VREFIR(n)+VREFDR(n) \quad (16)$$

Then, at a step S97, limit-checking of the desired correction value VREFR(n) is carried out, similarly to the limit-checking of the VREFM value shown in FIG. 11.

After execution of the limit-checking of the RFEFR(n) value, the program proceeds to a step S98, wherein a correction value ΔVRREFM for the reference value VRREFM for the MO2 sensor output is determined, followed by terminating the program.

Figure 12B:
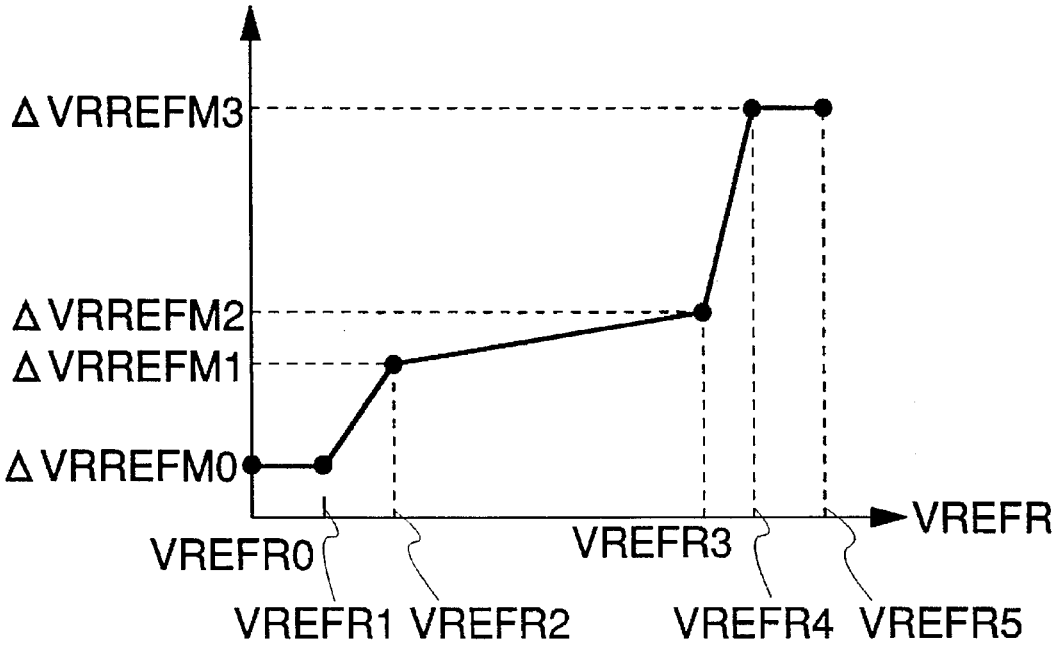
FIG. 12B shows a ΔVRREFM table.

The correction value ΔVRREFM is determined e.g. by retrieving a ΔVRREFM table shown in FIG. 12B. The ΔVRREFM table is set such that table values ΔVRREFM0 to ΔVRREFM3 are provided correspondingly to predetermined values VREFR0 to VREFR5 of the desired correction value VREFR. The correction value ΔVRREFM is determined by retrieving the ΔVRREFM table, or additionally by interpolation, if required. As is clear from FIG. 12B, the ΔVRREFM value is generally set to a larger value as the VREFR(n) value assumes a larger value. Further, the VREFR value has been subjected to the limit-checking at the step S97, and accordingly the air-fuel ratio correction value ΔVRREFM is also set to a value within a range defined by predetermined upper and lower limit values.

If NIVRR>0 holds at the step S91, the count value of the counter NIVRR is decremented by the thinning-out TDC number NIR at a step S99, and then the aforementioned difference ΔVR, the integral term VREFIR of the desired correction value, and the correction value ΔVRREFM are held at the values assumed in the immediately preceding loops, respectively at steps S100, S101 and S102, followed by terminating the program.

As described above, according to the present embodiment, the maps for determining the control gains (KVPM, KVIM, KVDM, KVPR, KVIR and KVDR) and the thinning-out variables (NIVRM and NIVRR) of the feedback control based on the outputs from the O2 sensors 22 and 23, each consist of four maps corresponding to the operating states determined by the bypass valve 11 and the valve timing changeover mechanism 30, and therefore an updating rate of the control constant suitable for each operating state can be obtained, to thereby improve the controllability of the air-fuel ratio and the convergency of the air-fuel ratio feedback control.

Figure 14:
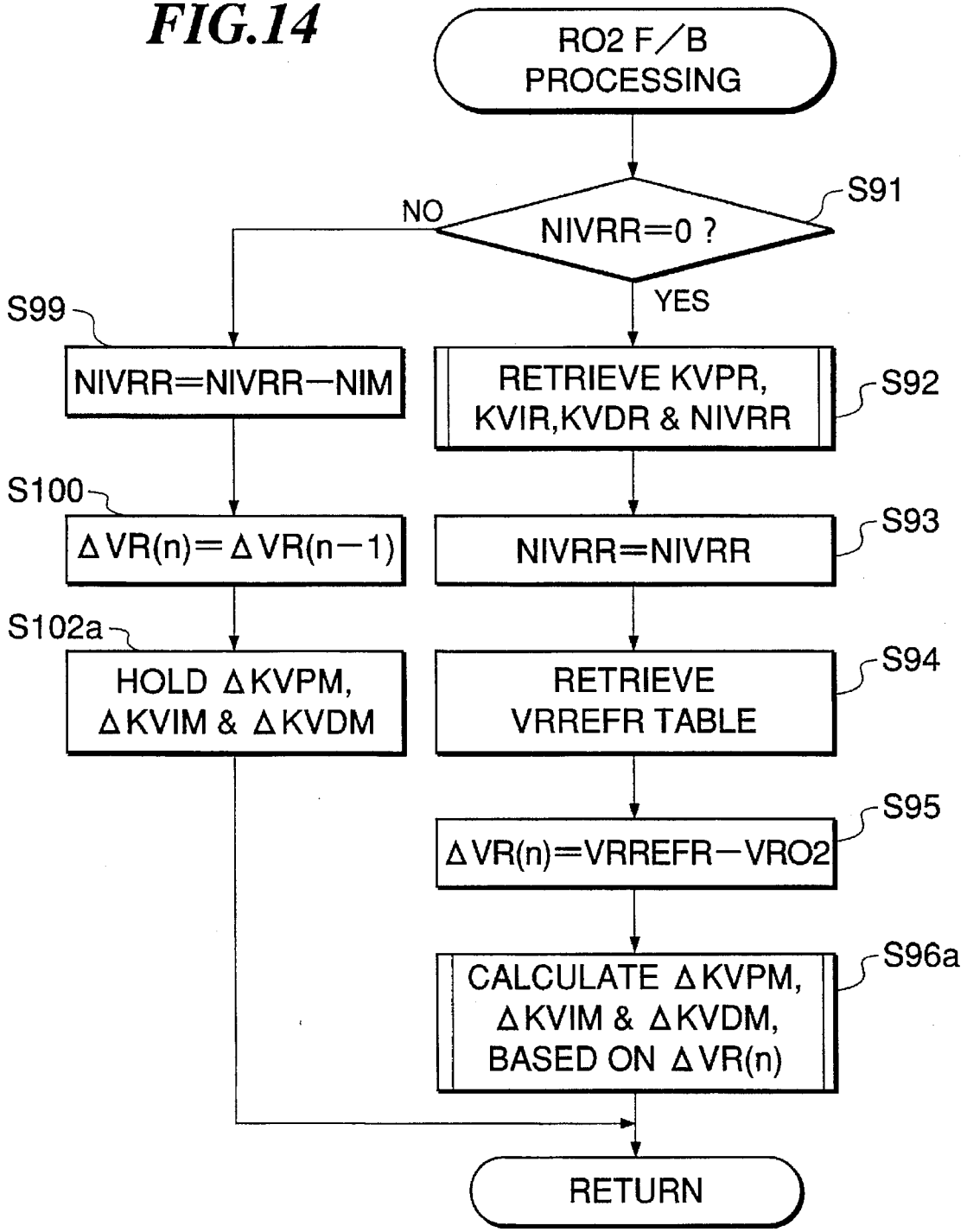
FIG. 14 is a flowchart showing a variation of the subroutine of FIG. 13.

FIG. 14 shows a variation of the above described embodiment, specifically, a variation of the RO2 feedback-processing routine. According to this variation, instead of correcting the reference value VRREFM, based on the RO2 sensor output VRO2, the control gains KVPM (proportional term coefficient), KVIM (integral term coefficient), and KVDM (differential term coefficient) are corrected based on the RO2 sensor output VRO2.

The processing of the FIG. 14 routine is identical with the processing of the FIG. 13 routine, except that the steps S96, S97, S98, S101 and S102 in FIG. 13 are omitted and steps S96*a* and 102*a* are added. Therefore, description of the identical steps is omitted.

Figure 15:
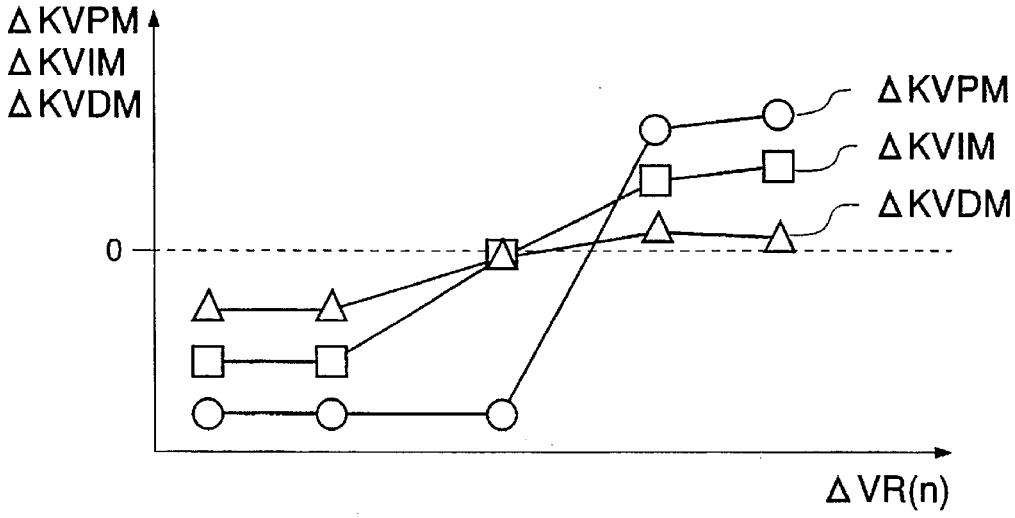
FIG. 15 shows a table which is used for calculating control constants for controlling the feedback control based on the MO2 sensor, according to the FIG. 14 variation.

At the step S96*a*, correction values ΔKVPM, ΔKVIM, and ΔKVDM for the respective control gains are calculated based on the difference ΔVR(n) calculated at the step S95. More specifically, the correction values are determined by retrieving a ΔKVPM table, a ΔKVIM table, and a ΔKVDM table shown in FIG. 15, respectively, according to the difference ΔVR(n), or additionally interpolation, if required. The respective correction values increase as the ΔVR(n) value assumes a larger value, however, the degrees of increase become smaller in the order of ΔKVPM, ΔKVIM, and ΔKVDM.

At the step S102*a*, the correction values ΔKVPM, ΔKVIM, and ΔKVDM are held at the values assumed in the immediately preceding loop.

According to the present variation, the control gains KVPM, KVIM and KVDM are determined at the step S62 in FIG. 9, and the thus determined values are corrected by the use of the following equations (17) to (19), respectively:

$$KVPM=KVPM+\Delta KVPM \quad (17)$$

$$KVIM=KVIM+\Delta KVIM \quad (18)$$

$$KVDM=KVDM+\Delta KVDM \quad (19)$$

Thus, the control gains KVPM, KVIM and KVDM are controlled in a feedback manner responsive to the RO2 sensor output VRO2.

The invention is not limited to the above described embodiment and variation, but various modifications thereof may be possible. For example, in place of correcting the desired air-fuel ratio coefficient KCMD, based on the MO2 sensor output VMO2, the control gains (KLAFFP, KLAFFI, and KLAFFD in the FIG. 4 program) of the feedback control based on the LAF sensor 21 output may be corrected in the same manner as in the FIG. 14 routine.

Further, in place of the thinning-out variables NIVRM and NIVRR, a timer may be employed to correct the desired air-fuel ratio coefficient KCMD or the reference value VRREFM whenever a predetermined time period elapses. Besides, an oxygen concentration sensor similar to the MO2 sensor 22 may be employed in place of the LAF sensor 21, or alternatively a linear oxygen concentration sensor similar to the LAF sensor 21 may be employed in place of the M02 sensor 22 and/or RO2 sensor 23.

In the present embodiment, the valve timing changeover mechanism 30 is constructed so as to change the valve timing of both the exhaust valves and the intake valves, but this is not limitative. Alternatively, the valve timing of either the exhaust valves alone or the intake valves alone may be changed. Further, the mechanism 30 may be constructed such that one of the pair of intake valves and/or one of the pair of exhaust valves is made inoperative when the low-speed valve timing is selected. Besides, the mechanism 30 may be constructed such that the valve timing is linearly or steplessly changeable, instead of being changeable between two steps. If such an alternative construction is employed, it is desirable that the KP map, the KVPM map, the KVPR map, etc. do not each consist of a plurality of maps but consist of a single map, wherein a map value read out from the single map is corrected according to the valve timing.

Further, the intake passage changeover mechanism (bypass valve 11, low-speed passage 10, and actuator 12) may be arranged at a location upstream of the throttle valve 3', for common use for all the cylinders of the engine 1. Further, in addition to changing the cross-sectional area (diameter) and length of the intake passage between the low-speed passage 10 and the passage with increased diameter and increased length including the section *2a–2b* of the intake pipe 2, the volume of the chamber 7 may be changed depending on operating conditions of the engine.

Still further, although in the above described embodiment the intake passage and the valve timing are both made variable, only one of them may be made variable.

What is claimed is:

1. An air-fuel ratio control system for an internal combustion engine having an exhaust passage, and at least one catalytic converter arranged in said exhaust passage for purifying exhaust gases emitted from said engine, comprising:

air intake characteristic-changing means for changing air intake characteristics of said engine, based on operating conditions of said engine;

a plurality of exhaust gas component concentration sensors including at least an upstream exhaust gas component concentration sensor and a downstream exhaust gas component concentration sensor arranged in said exhaust passage at respective locations upstream and downstream of said at least one catalytic converter, for detecting concentration of a specific component in said exhaust gases;

first feedback control means for controlling an air-fuel ratio of an air-fuel mixture to be supplied to said engine to a desired air-fuel ratio in a feedback manner responsive to an output from said upstream exhaust gas component concentration sensor;

second feedback control means for calculating a feedback control parameter for use by said first feedback control means, based on an output from said downstream exhaust gas component concentration sensor; and updating rate-changing means for changing an updating rate of said feedback control parameter when said feedback control parameter is calculated, according to an operative state of said air intake characteristic-changing means, wherein said engine includes at least one intake valve, and at least one exhaust valve, said air intake characteristic-changing means changing valve timing of at least one of said at least one intake valve and said at least one exhaust valve, based on operating conditions of said engine.

2. An air-fuel ratio control system for an internal combustion engine having an exhaust passage, and at least one catalytic converter arranged in said exhaust passage, for purifying exhaust gases emitted from said engine, comprising:

air intake characteristic-changing means for changing air intake characteristics of said engine, based on operating conditions of said engine;

a plurality of exhaust gas component concentration sensors including at least an upstream exhaust gas component concentration sensor and a downstream exhaust gas component concentration sensor arranged in said exhaust passage at respective locations upstream and downstream of said at least one catalytic converter, for detecting concentration of a specific component in said exhaust gases;

first feedback control means for controlling an air fuel ratio of an air fuel mixture to be supplied to said engine to a desired air-fuel ratio in a feedback manner responsive to an output from said upstream exhaust gas component concentration sensor;

second feedback control means for calculating a feedback control parameter for use by said first feedback control means, based on an output from said downstream exhaust gas component concentration sensor; and updating rate-changing means for changing an updating rate of said feedback control parameter when said feedback control parameter is calculated, according to an operative state of said air intake characteristic-changing means, wherein said engine includes an intake passage, said air intake characteristic-changing means changing at least one of a cross sectional area of said intake passage and a length of said intake passage, based on operating conditions of said engine.

3. An air-fuel ratio control system for an internal combustion engine having an exhaust passage, and at least one catalytic converter arranged in said exhaust passage, for purifying exhaust gases emitted from said engine, comprising:

air intake characteristic-changing means for changing air intake characteristics of said engine, based on operating conditions of said engine;

a plurality of exhaust gas component concentration sensors including at least an upstream exhaust gas component concentration sensor and a downstream exhaust gas component concentration sensor arranged in said exhaust passage at respective locations upstream and downstream of said at least one catalytic converter, for detecting concentration of a specific component in said exhaust gases;

first feedback control means for controlling an air-fuel ratio of an air-fuel mixture to be supplied to said engine to a desired air-fuel ratio in a feedback manner responsive to an output from said upstream exhaust gas component concentration sensor;

second feedback control means for calculating a feedback control parameter for use by said first feedback control means, based on an output from said downstream exhaust gas component concentration sensor; and updating rate-changing means for changing an updating rate of said feedback control parameter when said feedback control parameter is calculated, according to an operative state of said air intake characteristic-changing means, wherein said engine includes at least one intake valve, at least one exhaust valve, and an intake passage, said air intake characteristic-changing means changing valve timing of at least one of said at least one intake valve and said at least one exhaust valve, and also changing at least one of a cross sectional area of said intake passage and a length of said intake passage, based on operating conditions of said engine.

4. An air-fuel ratio control system as claimed in any of claims 1, 2 or 3, wherein said engine includes a first catalytic converter arranged in said exhaust passage, and a second catalytic converter arranged in said exhaust passage at a location downstream of said first catalytic converter, said air-fuel ratio control system including a first exhaust gas component concentration sensor arranged at a location upstream of said first catalytic converter, a second exhaust gas component concentration sensor arranged at a location downstream of said first catalytic converter and upstream of said second catalytic converter, and a third exhaust gas component concentration sensor arranged at a location downstream of said second catalytic converter, said first exhaust gas component concentration sensor forming said upstream exhaust gas component concentration sensor, said second exhaust gas component concentration sensor forming said downstream exhaust gas component concentration sensor.

5. An air-fuel ratio control system as claimed in any of claims 1, 2 or 3, wherein said engine includes a first catalytic converter arranged in said exhaust passage, and a second catalytic converter arranged in said exhaust passage at a location downstream of said first catalytic converter, said air-fuel ratio control system including a first exhaust gas component concentration sensor arranged at a location upstream of said first catalytic converter, a second exhaust gas component concentration sensor arranged at a location downstream of said first catalytic converter and upstream of said second catalytic converter, and a third exhaust gas component concentration sensor arranged at a location downstream of said second catalytic converter, said second exhaust gas component concentration sensor forming said upstream exhaust gas component concentration sensor, said third exhaust gas component concentration sensor forming said downstream exhaust gas component concentration sensor.

6. An air-fuel ratio control system as claimed in claim 4, wherein said feedback control parameter corresponds to said desired air-fuel ratio (KCMDM).

7. An air-fuel ratio control system as claimed in claim 6, wherein said updating rate-changing means changes control gains (KVPM, KVIM, and KVDM) for use in calculating said feedback control parameter, according to said operative state of said air intake characteristic-changing means.

8. An air-fuel ratio control system as claimed in claim 5, wherein said feedback control parameter is a reference output (VRREFM) to be compared with an output from said second exhaust gas component concentration sensor to determine said desired air-fuel ratio (KCMDM).

9. An air-fuel ratio control system as claimed in claim 8, wherein said updating rate-changing means changes control gains (KVPR, KVIR, and KVDR) for use in calculating a correction value (ΔVRREFM) for correcting said reference output (VRREFM), based on an output from said third exhaust gas component concentration sensor, according to said operative state of said air intake characteristic-changing means.

10. An air-fuel ratio control system as claimed in claim 8, wherein said updating rate characteristic-changing means changes correction values (ΔKVPM, ΔKVIM, and ΔKVDM) for correcting control gains (KVPM, KVIM, and KVDM) for use in calculating said feedback control parameter, based on an output from said third exhaust gas component concentration sensor, according to said operative state of said air intake characteristic-changing means.

11. An air-fuel ratio control system for an internal combustion engine having an exhaust passage, and at least one catalytic converter arranged in said exhaust passage, for purifying exhaust gases emitted from said engine, comprising:

air intake characteristic-changing means for changing air intake characteristics of said engine, based on operating conditions of said engine;

a plurality of exhaust gas component concentration sensors including at least an upstream exhaust gas component concentration sensor and a downstream exhaust gas component concentration sensor arranged in said exhaust passage at respective locations upstream and downstream of said at least one catalytic converter, for detecting concentration of a specific component in said exhaust gases;

first feedback control means for controlling an air-fuel ratio of an air-fuel mixture to be supplied to said engine to a desired air-fuel ration in a feedback manner using a first feedback control parameter (KCMDM) and a second feedback control parameter (KLAF) based on an output from said upstream exhaust gas component concentration sensor;

second feedback control means for calculating said first feedback control parameter for use by said first feedback control means, based on an output from said downstream exhaust gas component concentration sensor;

first updating rate-changing means for changing an updating rate of said first feedback control parameter effected when said first feedback control parameter is calculated, according to an operative state of said air intake characteristic-changing means; and second updating rate-changing means for changing an updating rate of said second feedback control parameter effected when said second feedback control parameter is calculated, according to an operative state of said air intake characteristic-changing means, wherein said engine includes at least one intake valve, and at least one exhaust valve, said air intake characteristic-changing means changing valve timing of at least one of said at least one intake valve and said at least one exhaust valve, based on operating conditions of said engine.

12. An air-fuel ratio control system as claimed in claim 11, wherein said second updating rate-changing means changes control gains (KP, KI, and KD) for use in calculating said second feedback control parameter, according to said operative state of said air intake characteristic-changing means.

13. An air-fuel ratio control system for an internal combustion engine having an exhaust passage, and at least one catalytic converter arranged in said exhaust passage, for purifying exhaust gases emitted from said engine, comprising:

air intake characteristic-changing means for changing air intake characteristics of said engine, based on operating conditions of said engine;

a plurality of exhaust gas component concentration sensors including at least an upstream exhaust gas component concentration sensor and a downstream exhaust gas component concentration sensor arranged in said exhaust passage at respective locations upstream and downstream of said at least one catalytic converter, for detecting concentration of a specific component in said exhaust gases;

first feedback control means for controlling an air-fuel ratio of an air-fuel mixture to be supplied to said engine to a desired air-fuel ration in a feedback manner using a first feedback control parameter (KCMDM) and a second feedback control parameter (KLAF) based on an output from said upstream exhaust gas component concentration sensor;

second feedback control means for calculating said first feedback control parameter for use by said first feedback control means, based on an output from said downstream exhaust gas component concentration sensor;

first updating rate-changing means for changing an updating rate of said first feedback control parameter effected when said first feedback control parameter is calculated, according to an operative state of said air intake characteristic-changing means; and second updating rate-changing means for changing an updating rate of said second feedback control parameter effected when said second feedback control parameter is calculated, according to an operative state of said air intake characteristic-changing means, wherein said engine includes an intake passage, said air intake characteristic-changing means changing at least one of a cross sectional area of said intake passage and a length of said intake passage, based on operating conditions of said engine.

14. An air-fuel ratio control system for an internal combustion engine having an exhaust passage, and at least one catalytic converter arranged in said exhaust passage, for purifying exhaust gases emitted from said engine, comprising:

air intake characteristic-changing means for changing air intake characteristics of said engine, based on operating conditions of said engine;

a plurality of exhaust gas component concentration sensors including at least an upstream exhaust gas component concentration sensor and a downstream exhaust gas component concentration sensor arranged in said exhaust passage at respective locations upstream and downstream of said at least one catalytic converter, for detecting concentration of a specific component in said exhaust gases;

first feedback control means for controlling an air-fuel ratio of an air-fuel mixture to be supplied to said engine to a desired air-fuel ration in a feedback manner using a first feedback control parameter (KCMDM) and a second feedback control parameter (KLAF) based on an output from said upstream exhaust gas component concentration sensor;

second feedback control means for calculating said first feedback control parameter for use by said first feedback control means, based on an output from said downstream exhaust gas component concentration sensor;

first updating rate-changing means for changing an updating rate of said first feedback control parameter effected when said first feedback control parameter is calculated, according to an operative state of said air intake characteristic-changing means; and second updating rate-changing means for changing an updating rate of said second feedback control parameter effected when said second feedback control parameter is calculated, according to an operative state of said air intake characteristic-changing means, wherein said engine includes at least one intake valve, at least one exhaust valve, and an intake passage, said air intake characteristic-changing means changing valve timing of at least one of said at least one intake valve and said at least one exhaust valve, and also changing at least one of a cross sectional area of said intake passage and a length of said intake passage, based on operating conditions of said engine.

15. An air-fuel ratio control system as recited in either of claims 13 or 14, wherein said second updating rate-changing means changes control gains (KP, KI, and KD) for use in calculating said second feedback control parameter, according to said operative state of said air intake characteristic-changing means.

* * * * *